US011300375B2

(12) United States Patent
Denson, III et al.

(10) Patent No.: US 11,300,375 B2
(45) Date of Patent: Apr. 12, 2022

(54) LAST ROUND HOLD OPEN APPARATUS

(71) Applicants: Dennis Leon Denson, III, Scottsboro, AL (US); Dennis Leon Denson, IV, Scottsboro, AL (US)

(72) Inventors: Dennis Leon Denson, III, Scottsboro, AL (US); Dennis Leon Denson, IV, Scottsboro, AL (US)

(73) Assignee: D & D Design Machine Inc., Scottsboro, AL (US)

( * ) Notice: Subject to any disclaimer, the term of this patent is extended or adjusted under 35 U.S.C. 154(b) by 0 days.

(21) Appl. No.: 17/142,492

(22) Filed: Jan. 6, 2021

(65) Prior Publication Data

US 2021/0164747 A1 Jun. 3, 2021

Related U.S. Application Data

(63) Continuation-in-part of application No. 16/738,651, filed on Jan. 9, 2020, now Pat. No. 10,890,394.

(60) Provisional application No. 62/790,750, filed on Jan. 10, 2019.

(51) Int. Cl.

| | |
|---|---|
| ***F41A 17/36*** | (2006.01) |
| ***F41A 9/59*** | (2006.01) |
| ***F41A 17/40*** | (2006.01) |

(52) U.S. Cl.

CPC ..... *F41A 17/36* (2013.01); *F41A 9/59* (2013.01); *F41A 17/40* (2013.01)

(58) Field of Classification Search

CPC ..... F41A 17/36; F41A 17/38; F41A 17/40; F41A 17/42; F41A 9/59

USPC ..... 42/70.01, 70.02

See application file for complete search history.

(56) References Cited

U.S. PATENT DOCUMENTS

| | | | | |
|---|---|---|---|---|
| 5,131,317 | A * | 7/1992 | Meller | F41A 17/36 89/138 |
| 9,952,011 | B2 * | 4/2018 | Overstreet | F41A 17/36 |
| 2010/0275485 | A1 * | 11/2010 | Findlay | F41A 35/06 42/16 |
| 2017/0045324 | A1 * | 2/2017 | Zeman | C22C 1/1078 |
| 2017/0138685 | A1 * | 5/2017 | Beasley | F41A 9/71 |
| 2019/0078850 | A1 * | 3/2019 | Cross | F41A 17/38 |

* cited by examiner

*Primary Examiner* — Jonathan C Weber

(74) *Attorney, Agent, or Firm* — Burr & Forman LLP; Jeffrey H. Kamenetsky, Esq.

(57) ABSTRACT

A last round hold open (LRHO) apparatus comprising a first lever having a first end and a second end; a second lever having a first end and a second end, the first end of the second lever in contact with the second end of the first lever; a bolt catch in contact with the second end of the second lever, and with a bolt carrier; and a follower in contact with the first end of the first lever, such that when the follower pushes up on the first end of the first lever, the second end of the first lever pushes down on the first end of the second lever, and the second end of the second lever pushes up on the bolt catch, resulting in activation of the bolt catch and opening the bolt carrier to alert an operator of the firearm that the firearm is out of ammunition.

8 Claims, 26 Drawing Sheets

LAST ROUND HOLD OPEN APPARATUS

CROSS REFERENCE TO RELATED APPLICATION

This application is a continuation-in-part of U.S. patent application Ser. No. 16/738,651, titled Last Round Hold Open Apparatus which claims priority to U.S. Provisional Patent Application No. 62/790,750, titled, Last Round Hold Open Apparatus, the disclosures of which are incorporated by reference.

FIELD

The present disclosure relates to firearms and firearm components and more specifically to an improved last round hold open (LRHO) apparatus for use with firearms, resulting in an accurate magazine height position.

BACKGROUND

Users of automatic rifles (ARs), particularly those that use Glock compatible ARs, often desire faster reloads. However, problems can arise when a new magazine is inserted within the firearm. For example, when a fresh magazine is inserted and the bolt is closed, there is additional resistance when the top round is pressed down. This can sometimes prevent proper seating. One way of achieving faster reloads is through the use of a Last Round Hold Open (LRHO) mechanism. LRHO systems are desirable because they allow for faster reloads. Thus, when the last round is fired, the bolt will stay open and a fresh full magazine can be inserted, a button can be pressed, the bolt will close, and the AR is ready to fire. Further, if the bolt was not held open, the user would have no visual indication that the rifle was empty. With a LRHO mechanism, the user does not have to take their eye from the scope of the firearm to change the magazine allow the user to focus on the target.

However, LRHO mechanisms are not without their inherent flaws. For example, existing LRHO mechanisms are not reliable because they are made from inexpensive, stamped out pieces of metal. This decreases the durability of the LRHO mechanism and reduces the likelihood that the LRHO mechanism will perform as designed when the last round is fired. Many existing LRHO mechanisms are large, unwieldy and cumbersome to use. In these designs, the LRHO may not perform to its capability because it interferes with other functioning components of the firearm. Further, many existing LRHO units have to be removed for general cleaning and cannot be visually checked for problems without first removing the LRHO from the firearm.

Therefore, what is needed is a LRHO mechanism that overcomes the deficiencies in current LRHO systems.

SUMMARY

In one aspect of the present disclosure, a last round hold open (LRHO) apparatus is provided. In one embodiment the LRHO apparatus includes a first lever having a first end and a second end, a mag stop component to which the first lever is pivotally affixed at the second end, a second lever disposed proximate the second end of the first lever, the second lever pivotally affixed to the mag stop, a bolt catch affixed to the mag stop and the second lever, and a magazine release extending from the first end of the first lever.

In another aspect of the present disclosure, an LRHO apparatus is provided, the LRHO apparatus comprising a first lever having a first end and a second end; a second lever having a first end and a second end, the first end of the second lever in contact with the second end of the first lever; a bolt catch in contact with the second end of the second lever, and with a bolt carrier; and a follower in contact with the first end of the first lever, such that when the follower pushes up on the first end of the first lever, the second end of the first lever pushes down on the first end of the second lever, and the second end of the second lever pushes up on the bolt catch, resulting in activation of the bolt catch and opening the bolt carrier to alert an operator of the firearm that the firearm is out of ammunition.

DETAILED DESCRIPTION OF EXEMPLARY EMBODIMENTS

Figure 1:
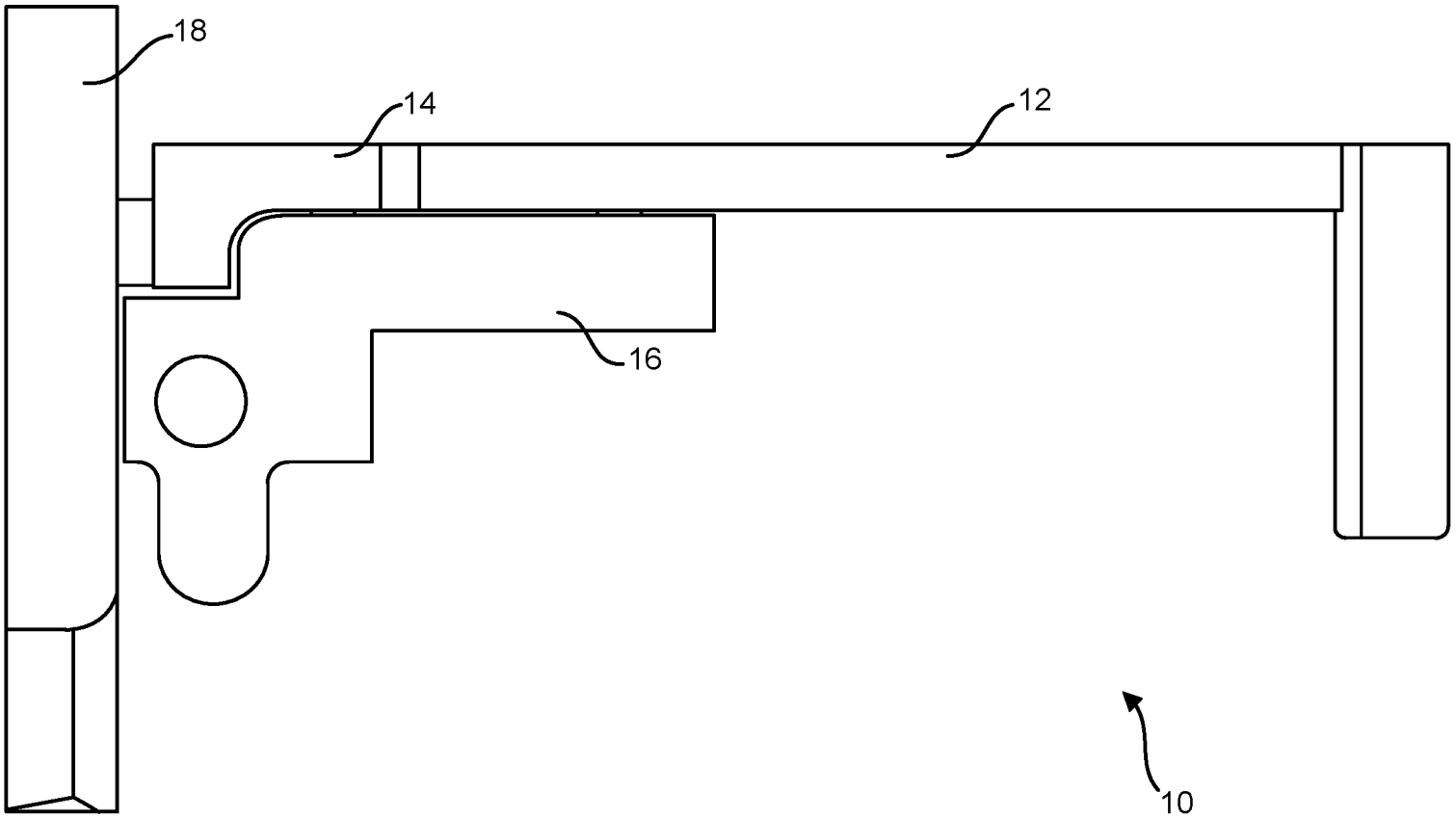
FIG. 1 is a top view showing the components of the LRHO apparatus of the present disclosure.

The present disclosure relates to a last round hold open (LRHO) apparatus for use in pistol caliber carbine (PCC) automatic rifle (AR) platforms. In one embodiment, the LRHO apparatus 10 of the present disclosure comprises four components, as shown in FIG. 1. The four components include a first lever 12, a second lever 14, a mag stop 16, and a bolt catch 18. When these components work in conjunction with each other as a unit, they create an accurate magazine height position in relationship to the LRHO apparatus 10.

If for some reason, there is a total failure of LRHO apparatus 10, the weapon could still function because mag stop 16 serves as a positive location for the magazine due to bosses for first lever 12 and second lever 14 that allow these levers to still operate. Thus, in one embodiment, should mag stop 16 be damaged, the magazine release 20 is machined to a specific tolerance that could also serve as a mag stop 16. In this scenario, while the user would lose the ability of LRHO apparatus 10 to function as normal, they would not lose the ability to operate the weapon.

LRHO apparatus 10 is located within the lower receiver portion 21 of a firearm (lower receiver portion 21 shown, for example, in FIG. 1012). The firearm could be any firearm and the present disclosure is not limited for use in a particular firearm. Non-limiting examples of firearms into which the LRHO apparatus 10 of the present disclosure may be incorporated are firearms with a Glock® magazine such as an Alpha Wolf® Pistol Caliber Carbine (PCC) or a Flint River Armory (FRA) CSA45. By being contained on the inside this prevents any damage due to the dropping or mishandling of the firearm. This location within the firearm also advantageously prevents accidental activation of the LRHO apparatus 10 so operators will not be confused as to the status of the firearm.

Figure 2:
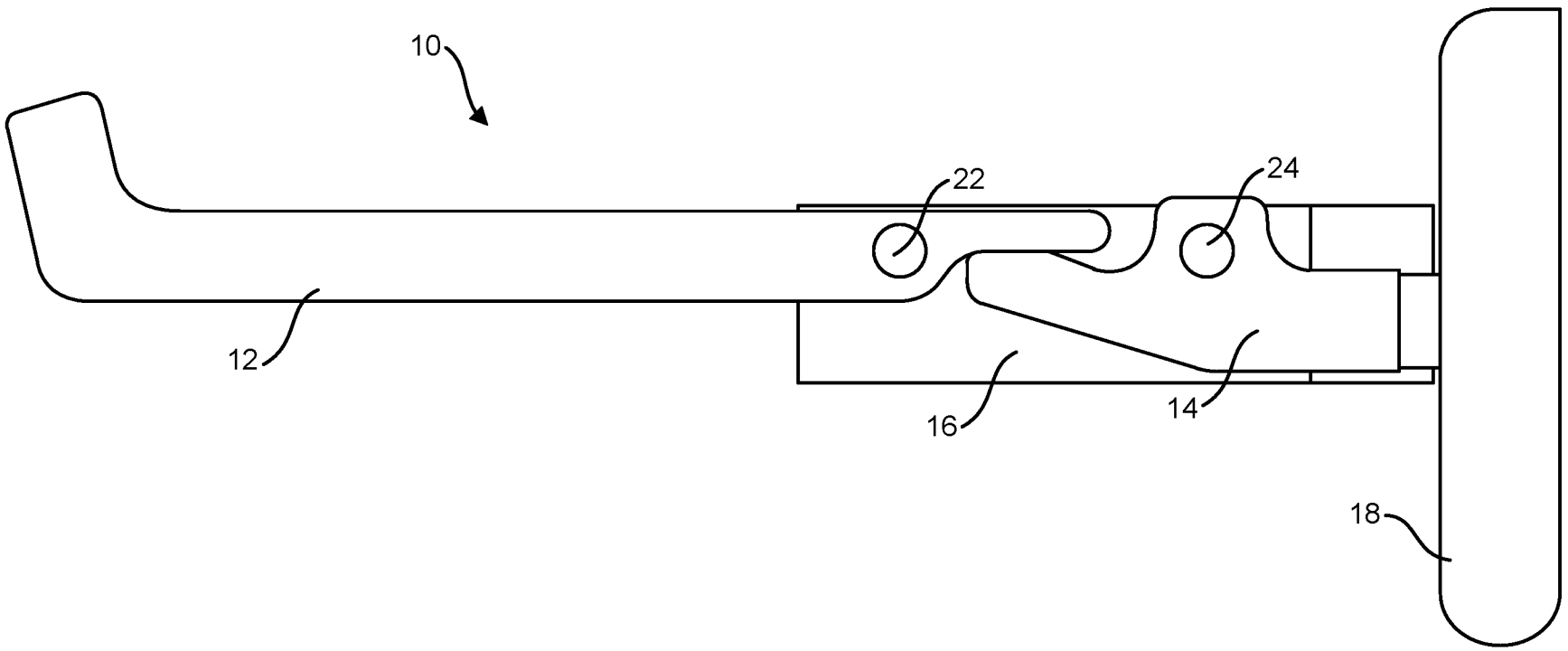
FIG. 2 is a side view of the LRHO apparatus of the present disclosure with the first lever in a down or closed position.
Figure 3:
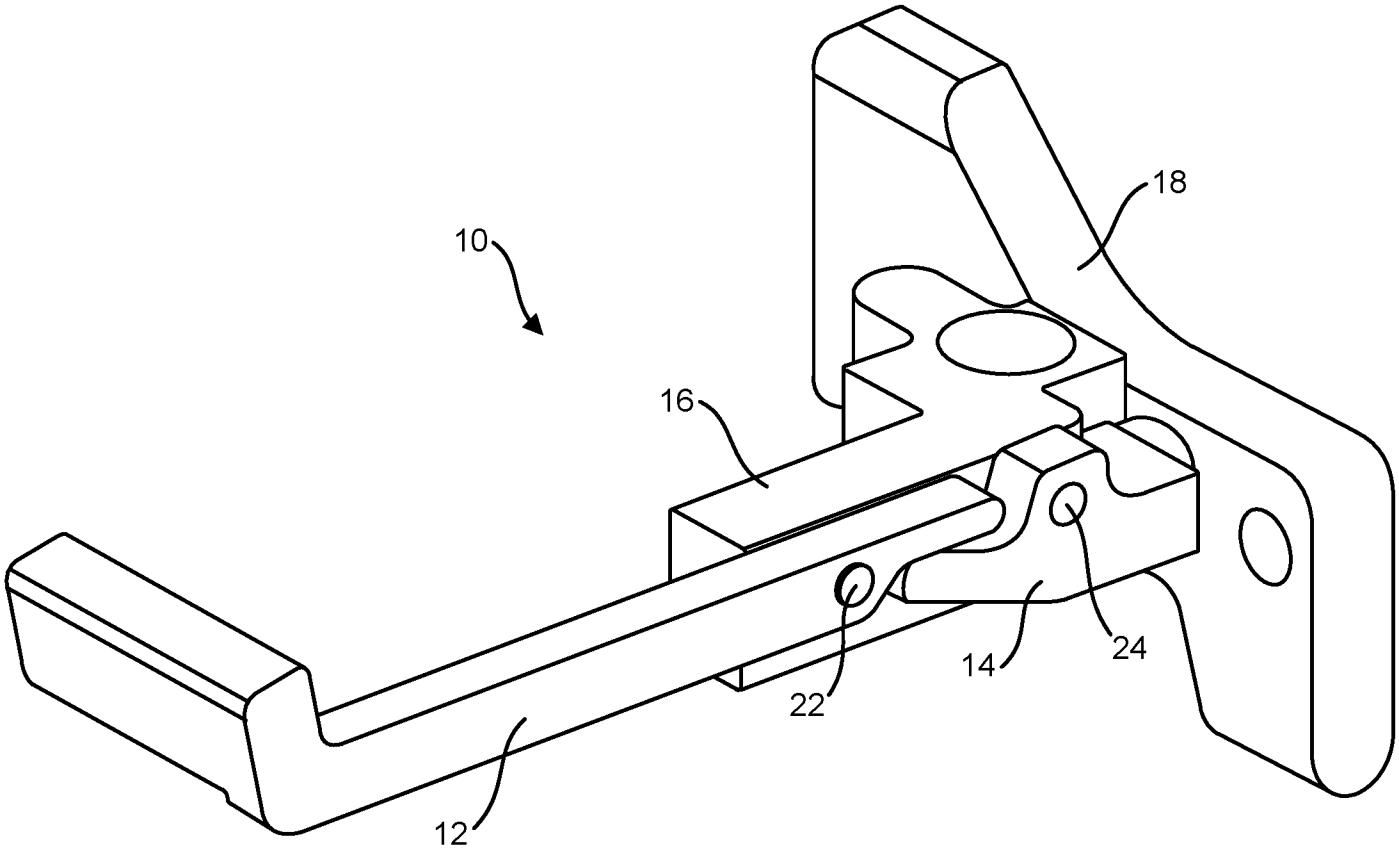
FIG. 3 is a front perspective view of the LRHO apparatus of the present disclosure with the first lever in a down or closed position.

In one embodiment, as shown in FIGS. 2 and 3, first lever 12 is pivotally connected to mag stop 16 via a first connector 22 at a first connection point and second lever 14 is pivotally connected to mag stop 16 via a second connector 24 at a second connection point. These connections maintain an accurate in-line position so that when the magazine follower makes contact with first lever 12, it assures engagement with second lever 14 and the overall function of LRHO apparatus 10.

Magazines consist of several components that, when assembled, can cause a tolerance build-up, which in turn causes the follower's 32 final stop position at the top of the magazine to vary. The design of LRHO apparatus 10 takes this variation into consideration and once first lever 12 and second lever 14 are activated, the final position of bolt catch 18 allows bolt catch 18 to travel a range large enough to accommodate the imperfections in many magazines.

Figure 4:
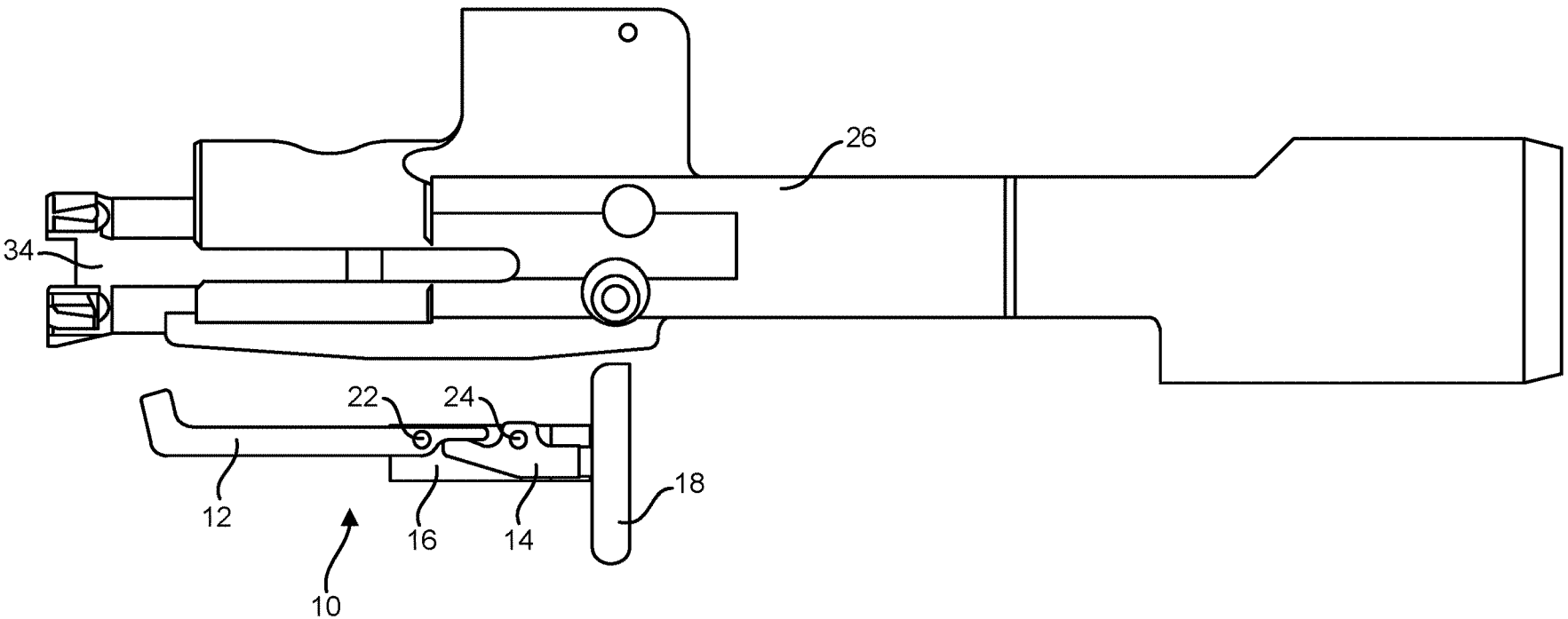
FIG. 4 is a side view of the LRHO apparatus of the present disclosure in relation to a bolt carrier.
Figure 5:
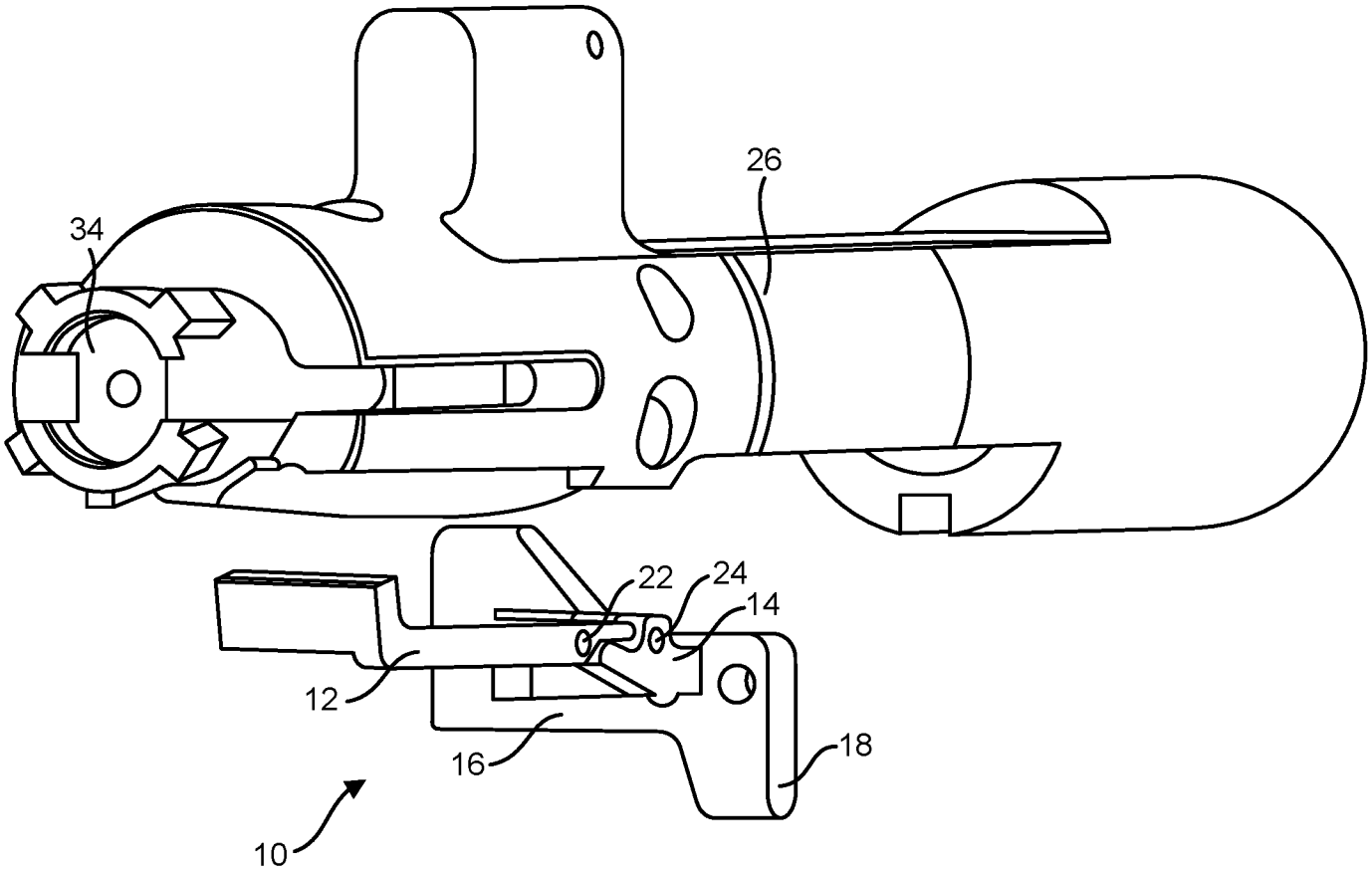
FIG. 5 is a perspective of the LRHO apparatus of the present disclosure in relation to a bolt carrier.

FIG. 4 and FIG. 5 show a bolt carrier 26 in relation to LRHO apparatus 10 to emphasize the compact nature of the LRHO apparatus and the clearance between the two components, which assures that there will be no interference during firearm operation.

Figure 6:
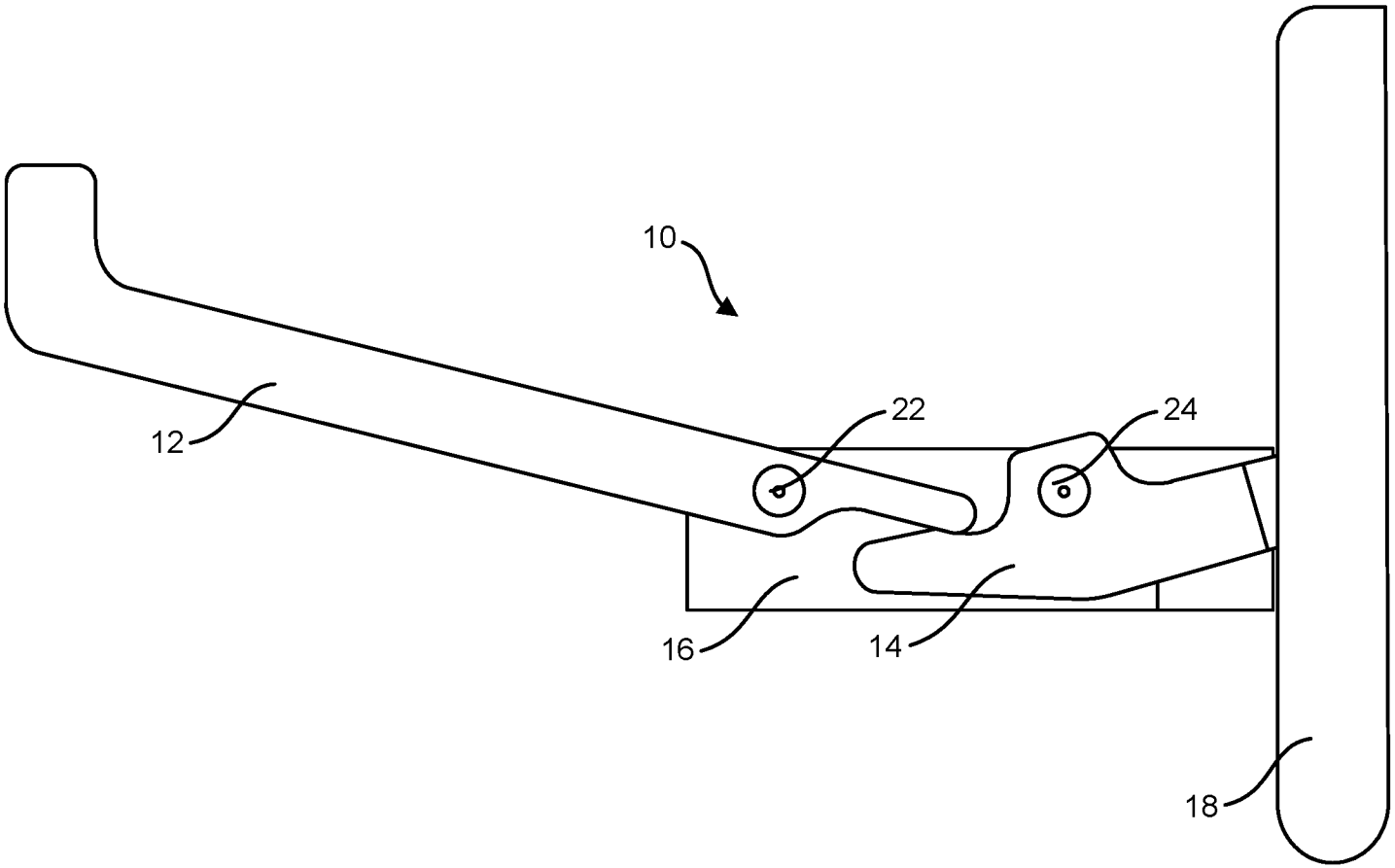
FIG. 6 is a side view of the LRHO apparatus of the present disclosure with the first lever in an up or open position.
Figure 7:
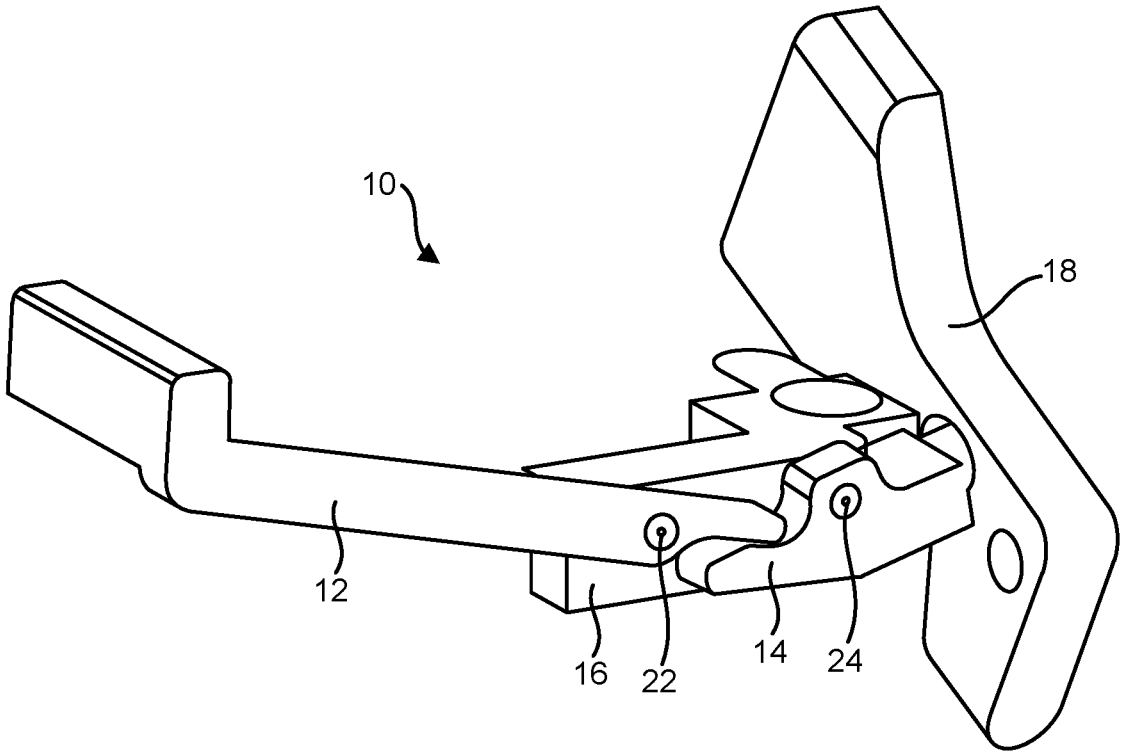
FIG. 7 is a perspective view of the LRHO apparatus of the present disclosure with the first lever in an up or open position.

FIG. 6 and FIG. 7 show LRHO apparatus 10 with lever 12 in an up or open position.

Figure 8:
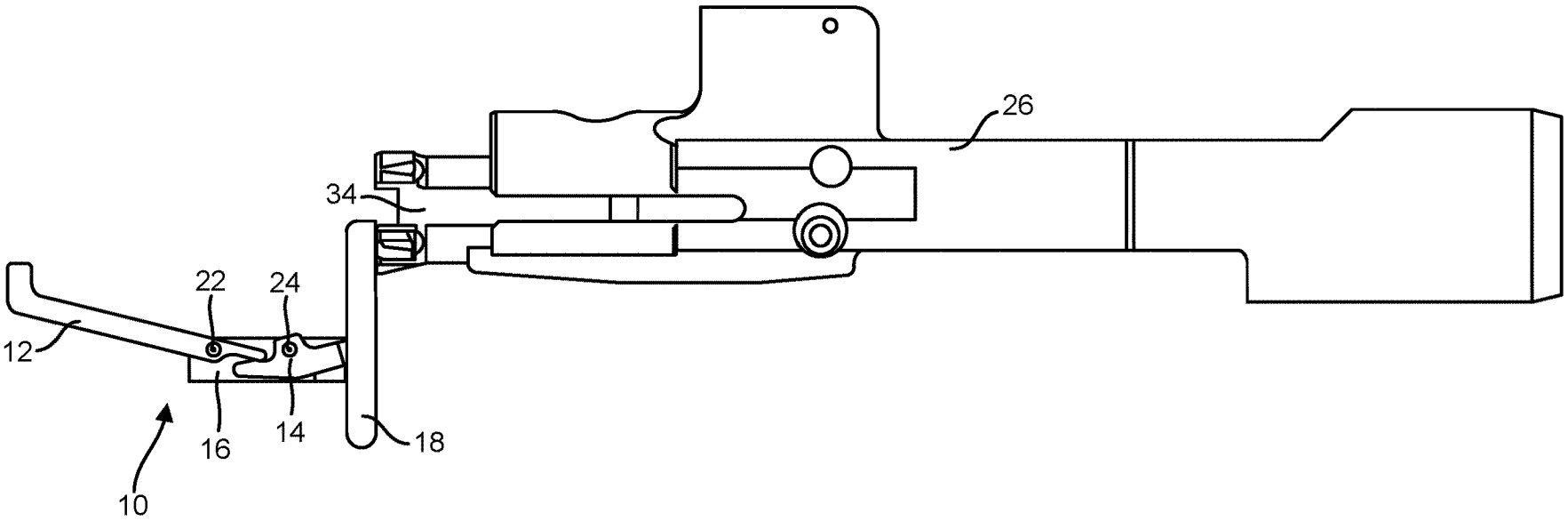
FIG. 8 is a side view of the LRHO apparatus of the present disclosure with the first lever in an up or open position showing the bolt catch activated and the bolt carrier in the back or open position.
Figure 9:
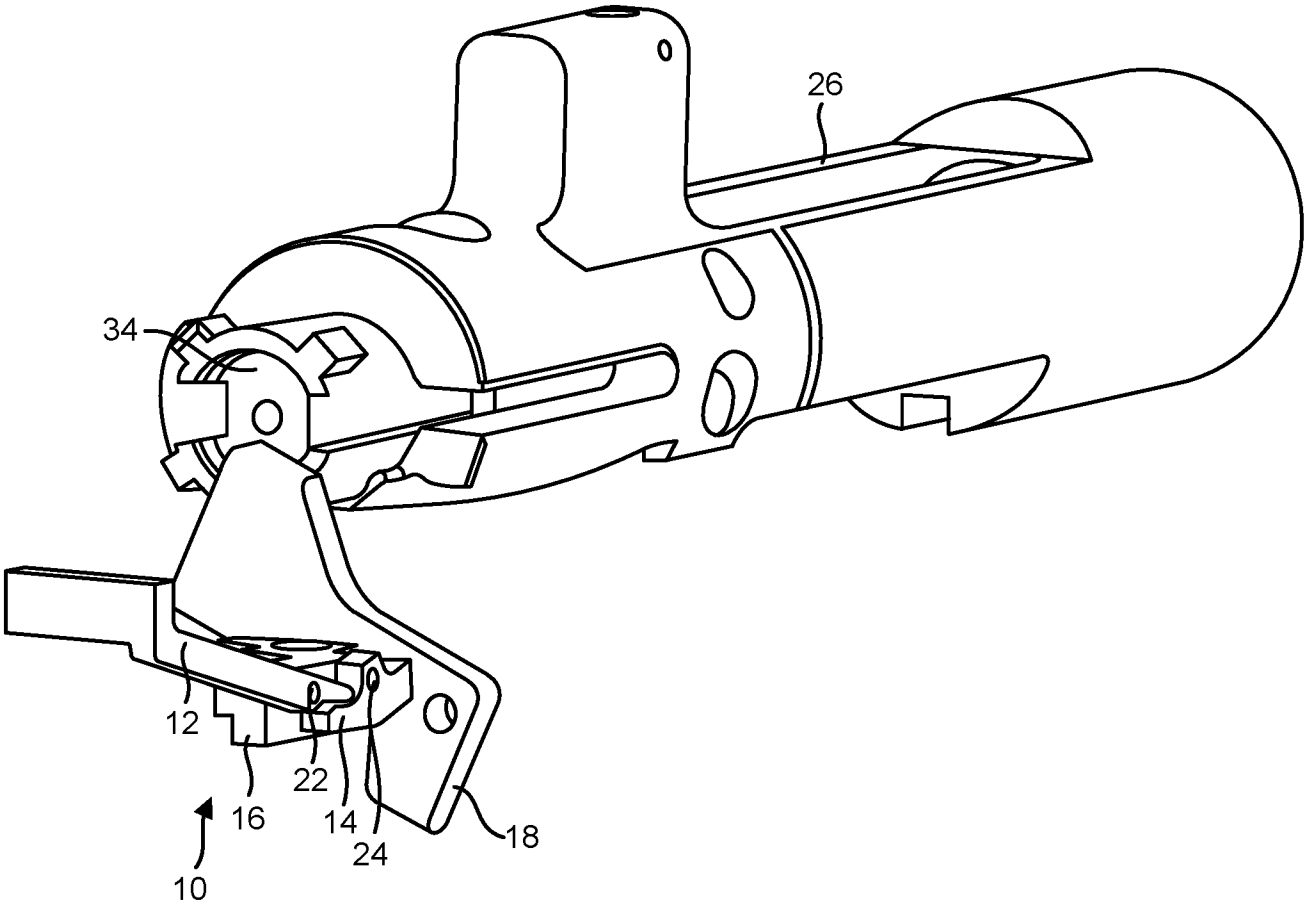
FIG. 9 is a perspective view of the LRHO apparatus of the present disclosure with the first lever in an up or open position showing the bolt catch activated.

In FIG. 8 and FIG. 9 LRHO apparatus 10 is shown with LRHO apparatus 10 in the up or open position. Here, bolt catch 18 has been activated by first lever 12 and second lever 14 and the bolt carrier 26 is stopped in the back or open position, thus alerting the operator that the firearm is out of ammunition.

Figure 10:
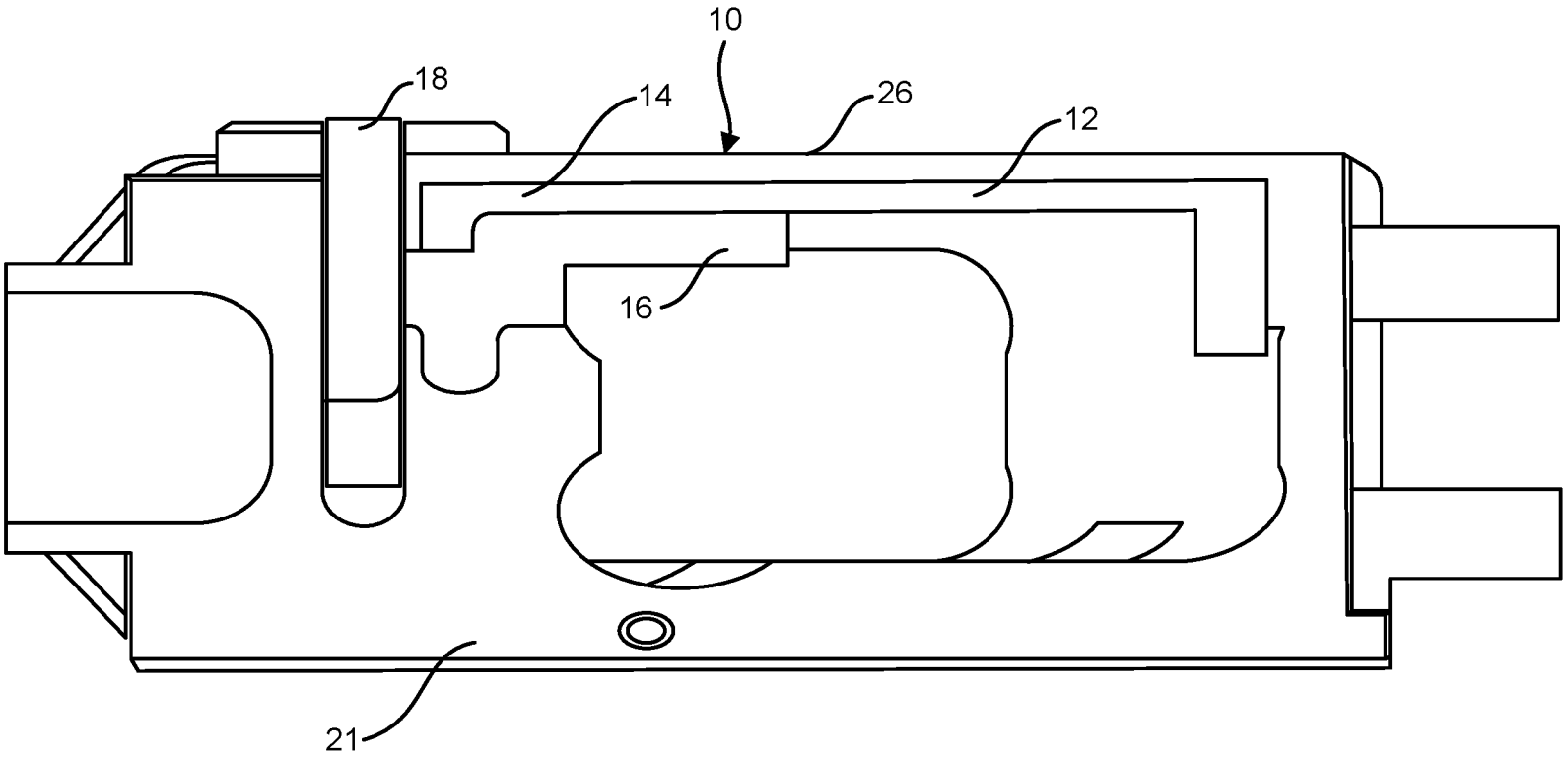
FIG. 10 is a top view of the LRHO apparatus of the present disclosure with the first lever in the down or closed position within the lower receiver.
Figure 11:
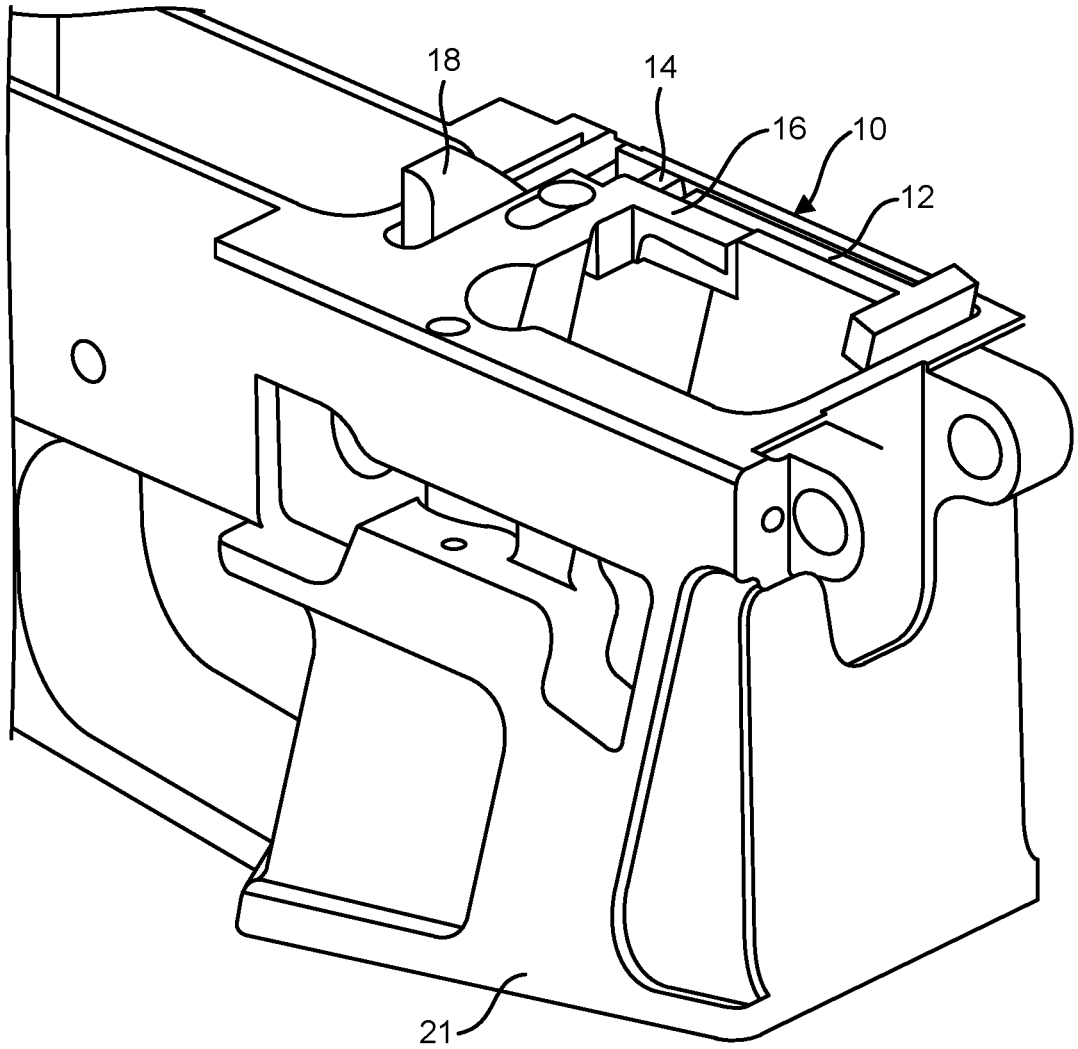
FIG. 11 is a perspective view of the LRHO apparatus of the present disclosure with the first lever in the down or closed position within the lower receiver.

FIG. 10 and FIG. 11 show LRHO apparatus 10 in the lower receiver of the firearm and in the down or closed position.

Figure 12:
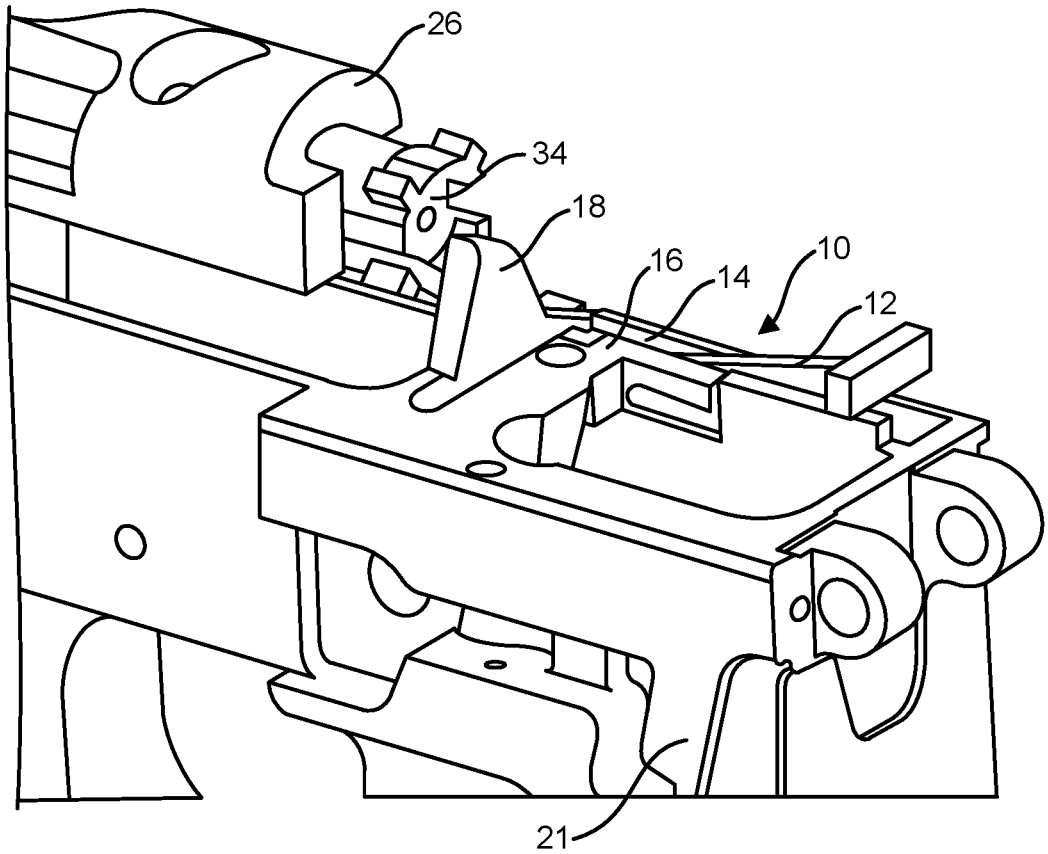
FIG. 12 is a perspective view of the LRHO apparatus of the present disclosure with the first lever in the up or open position within the lower receiver, with the bolt carrier stopped in the back or open position.

FIG. 12 shows LRHO apparatus 10 in the lower receiver in the up or open position with the bolt carrier 26 stopped in the back or open position.

Figure 13:
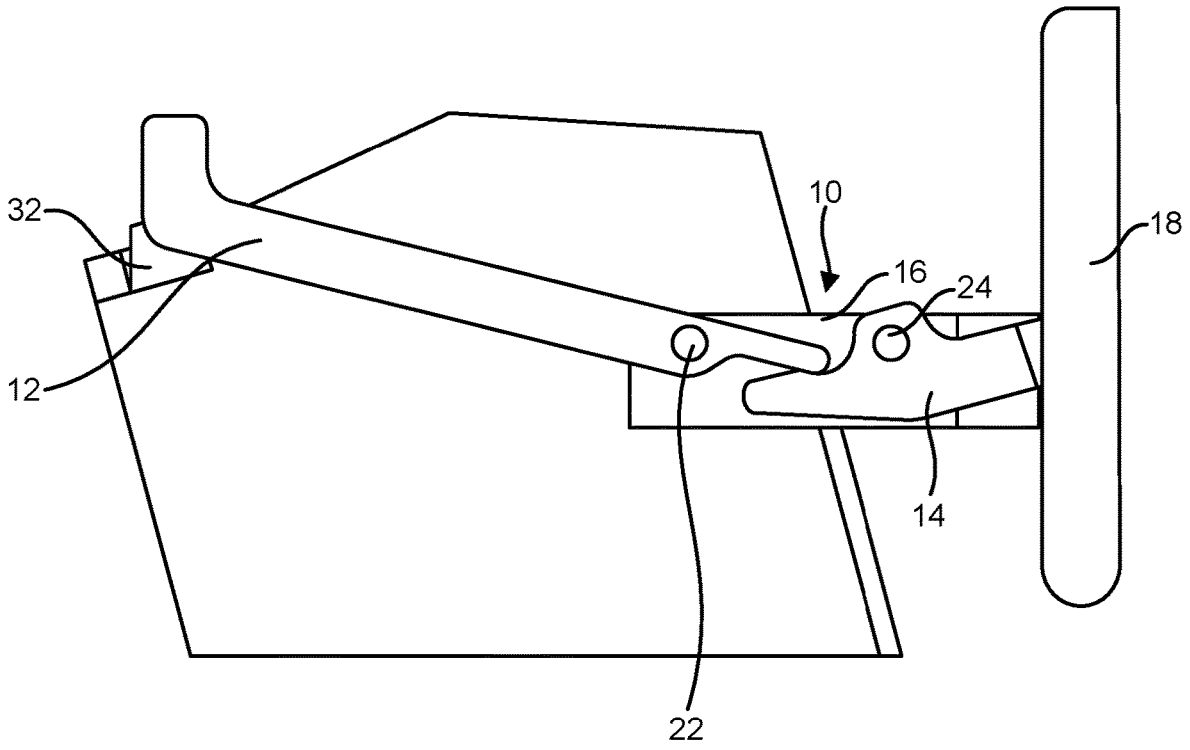
FIG. 13 is a side view showing LRHO apparatus being activated by the follower of the magazine.
Figure 14:
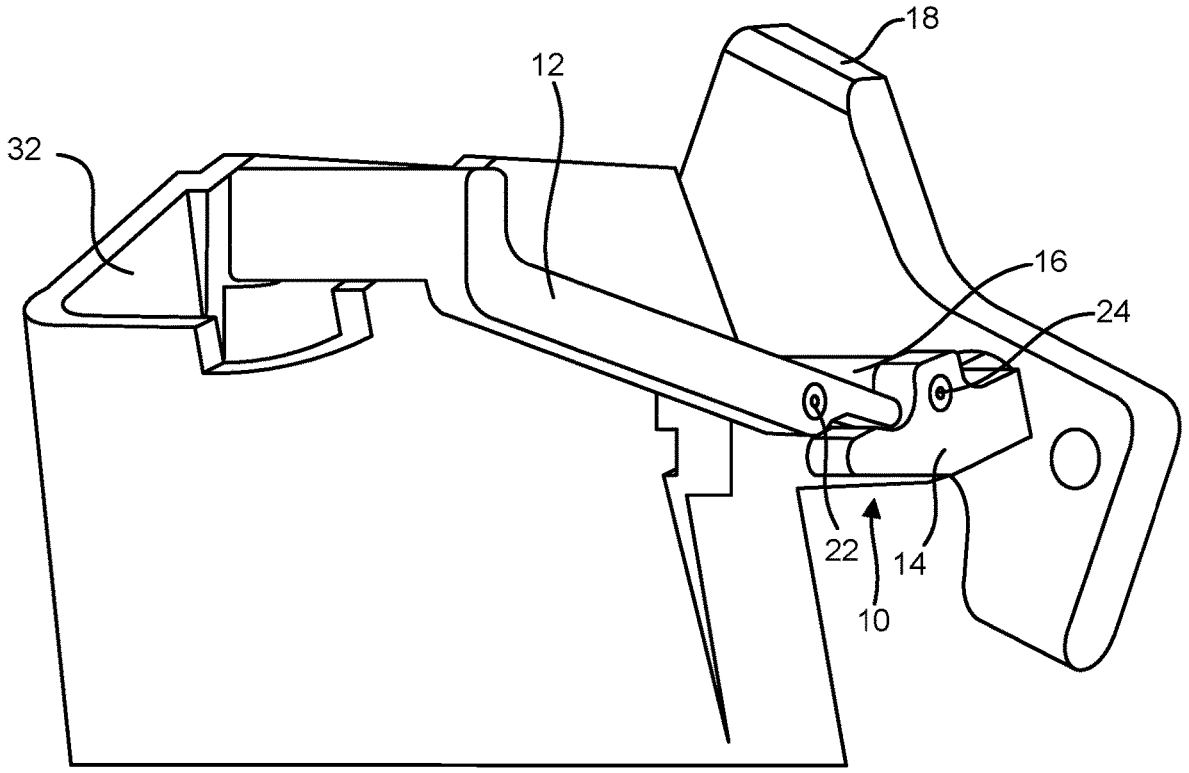
FIG. 14 is a perspective view showing LRHO apparatus being activated by the follower of the magazine.

In FIG. 13 and FIG. 14, the LRHO apparatus 10 can be seen being activated by the follower of the magazine.

Figure 15:
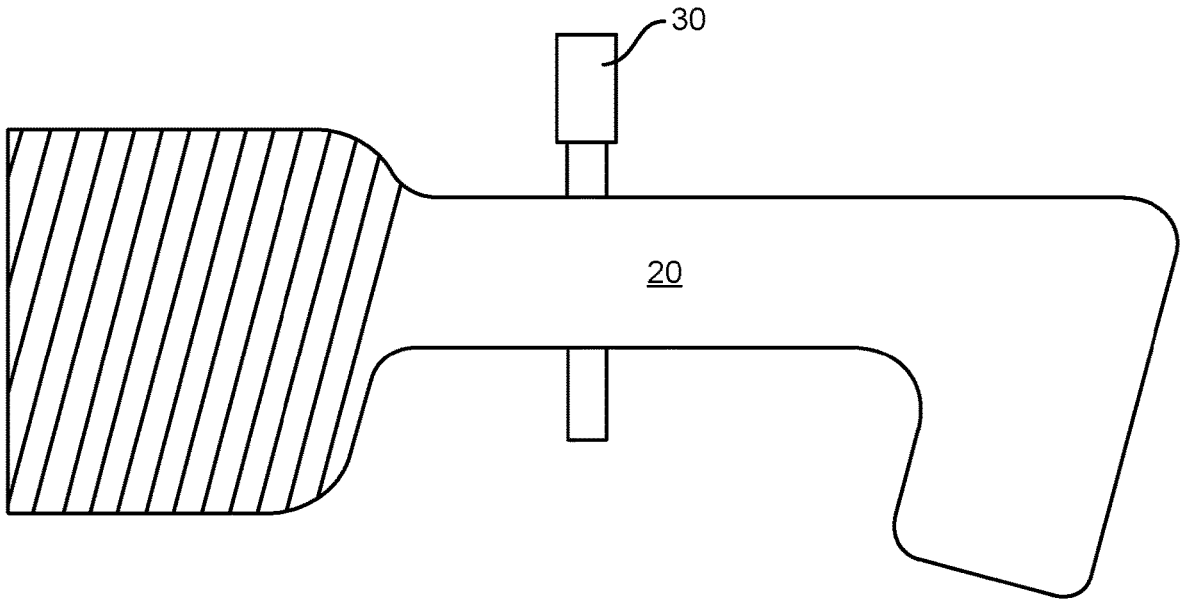
FIG. 15 is a side view of the magazine release with mag release pivot pin.

FIG. 15 is a side view of the magazine release 20 and pivot pin 30. Because of the size of magazine release 20 (it has a surface area of three times more than a typical mag release) and its position in lower receiver 21 (see, e.g., FIG. 17), it is easy to operate because it works on a hinge concept and could easily be operated by a person who has one or more fingers missing or incapacitated. As seen in FIG. 15, because of pivot pin 30, magazine release 20 can be activated pressing down on pivot pin 30, as opposed to typical magazine releases that require excess pressure to push and activate a spring, which could be difficult for persons having a missing finger or fingers that are incapacitated.

Figure 16:
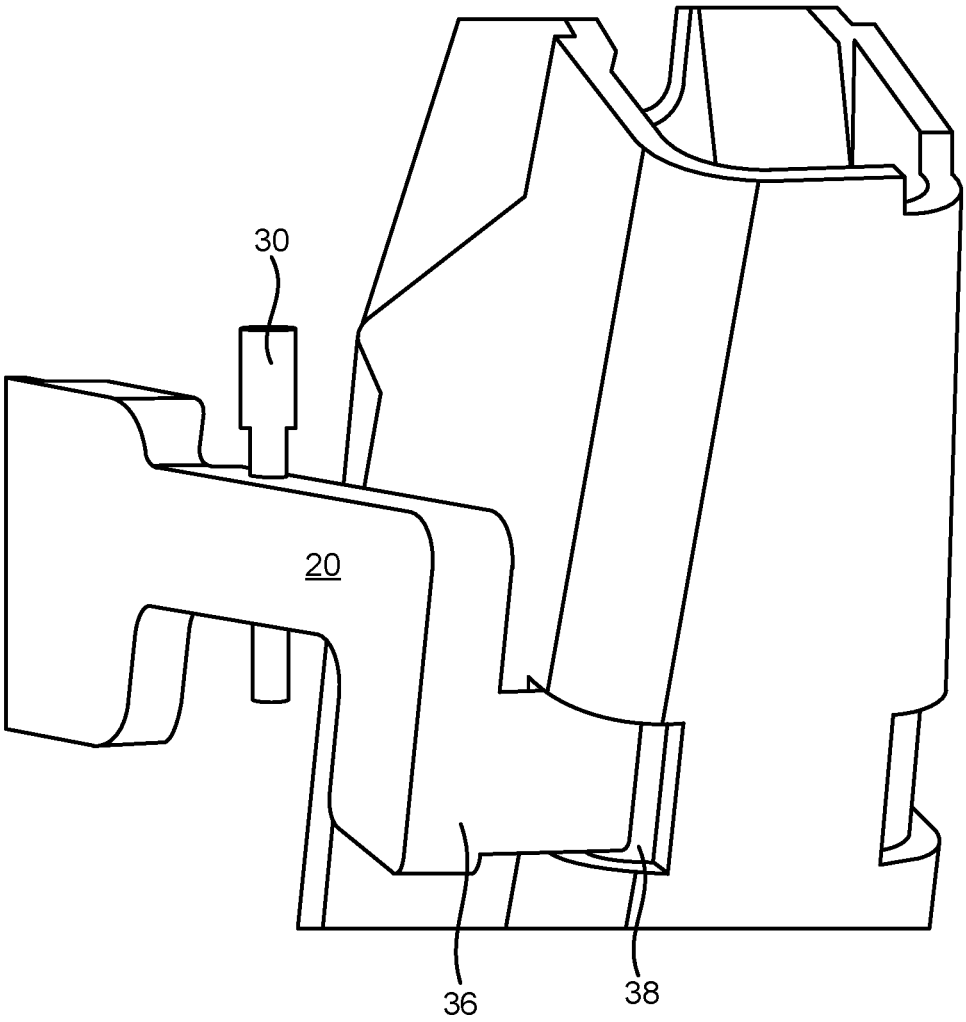
FIG. 16 is a perspective view of the magazine release locking into the magazine.

FIG. 16 is a perspective view of the magazine release 20 locking into the magazine.

Figure 17:
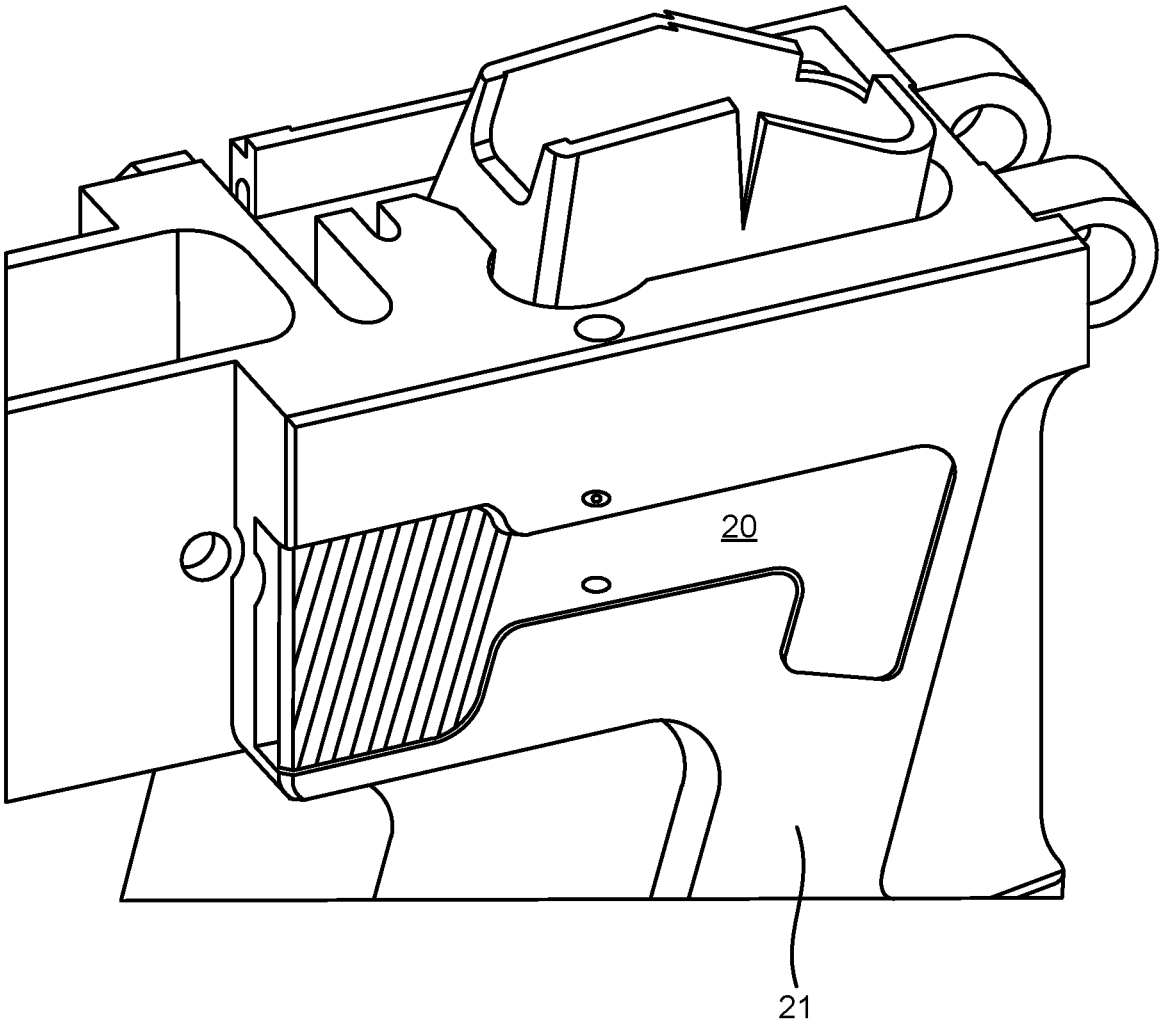
FIG. 17 is a perspective view of the magazine release in the lower receiver locked in a closed position.

FIG. 17 is a perspective view of the magazine release 20 in the lower receiver locked into the magazine in the closed position.

Figure 18:
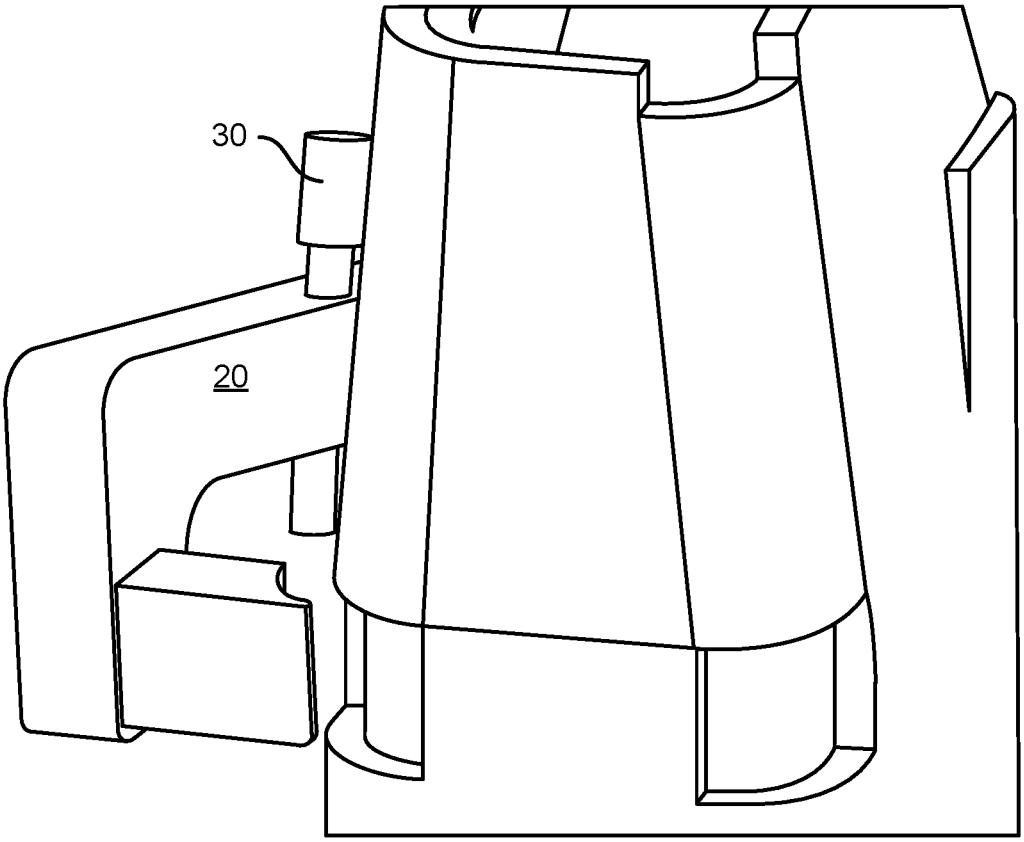
FIG. 18 is a perspective view of the magazine release in the open position.

FIG. 18 is a perspective view of the magazine release 20 in the open position. This shows clearance of the components which allows for unencumbered insertion of an empty magazine for a faster reload time.

Figure 19:
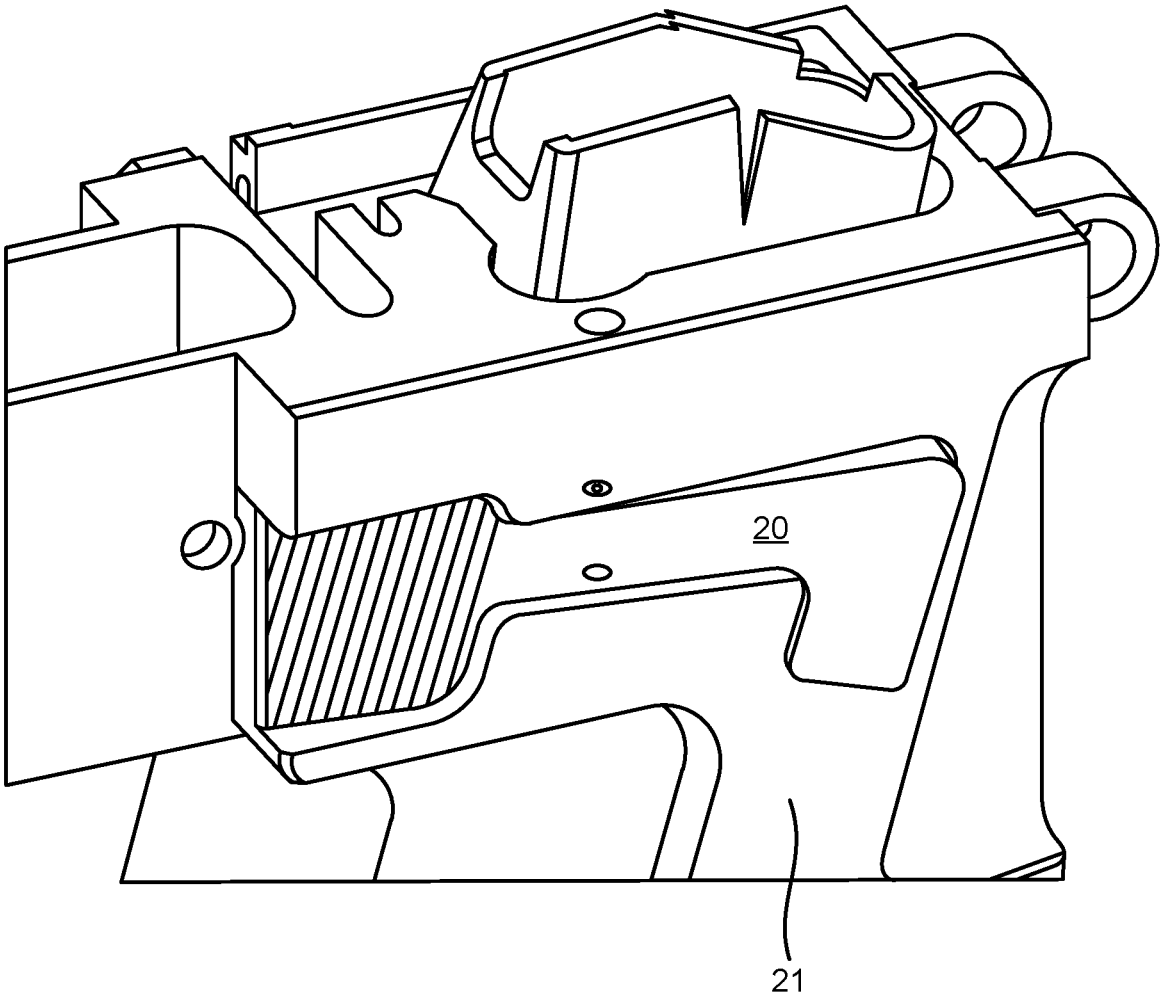
FIG. 19 is a perspective view of the magazine release in the open positon in the lower receiver.

FIG. 19 is a perspective view of the magazine release 20 in the open position in the lower receiver. This shows the small distance this component has to travel for a fast reload.

In one embodiment, mag stop 16 may include small connectors, or studs, machined into it with an in-line centerline, which establishes optimal positioning for first lever 12 and second lever 14. This design results in two advantages. The first being constant contact with the components of LRHO apparatus 10 for a smoother engagement. The second is a fast reaction to performance. The sturdy design and the accuracy of the machined components that comprise LRHO apparatus 10 as well as the material selection of the components provide an enhanced LRHO design in relation to other designs that use components that are essentially stamped-out sheet metal parts. Sheet metal components cannot maintain the accuracy or reliability of the LRHO apparatus 10 of the present disclosure.

The firearm includes a lower receiver portion with pockets machined therein in order to establish a mounting location that assures there is no interference with the LRHO apparatus 10, or any other moving part inside the firearm that would prevent the firearm from functioning and firing a round of ammunition.

LRHO apparatus 10 is configured to perform with the correct caliber Glock® magazine as well as any other after-market magazine that will fit into the gun and lock into position. The slim and compact profiles of the components of LRHO apparatus 10 along with the minimum surface contact of the pivot points allows for the LRHO apparatus 10 to function even with the weakest of magazine springs.

Advantageously, damage to LRHO apparatus 10 from magazine over travel is prevented in a number of different ways. First, magazine release 20 has a precision cut locator boss so that when the locator notch in the magazine engages this boss, it is locked in, thereby stopping over travel. Another way that LRHO apparatus 10 prevents over travel is if by chance a magazine has a worn notch, then mag stop 16 has a secondary land cut on it that engages the magazine and stops the over travel. Yet another way that over travel is prevented is should for any reason the first two stops malfunction, then a third stop is provided which is a fixed mechanical stop created by machining a slot in the upper receiver portion of a firearm to a precision depth that will hard stop first lever 12 from over-traveling.

To enhance the LRHO apparatus 10 performance due to fouling of some firearms, the position of the pocket cut into the lower receiver portion of the firearm along with a clearance notch for first lever 12 prevents any fouling from reaching the pivots studs on mag stop 16 thus preventing any malfunctions from dirt and gases.

In one embodiment, once installed, LRHO apparatus 10 is held in place by only a single connector, i.e., screw, which is more than sufficient because of the containment pocket machined into the lower receiver portion of the firearm. Mag Stop 16 is a component which drives the accuracy for location and performance. In one embodiment, LRHO apparatus 10 is pre-assembled and dropped into the pocket with ease. This also allows field-cleaning, if required, to be simplified.

Mag release 20 is positioned in such a way that those operators that have experience with an AR platform will not have to relearn this operation. Current muscle memory allows the person to operate a firearm utilizing the LRHO apparatus 10 of the present disclosure with ease and without experiencing any difficulties.

Figure 20:
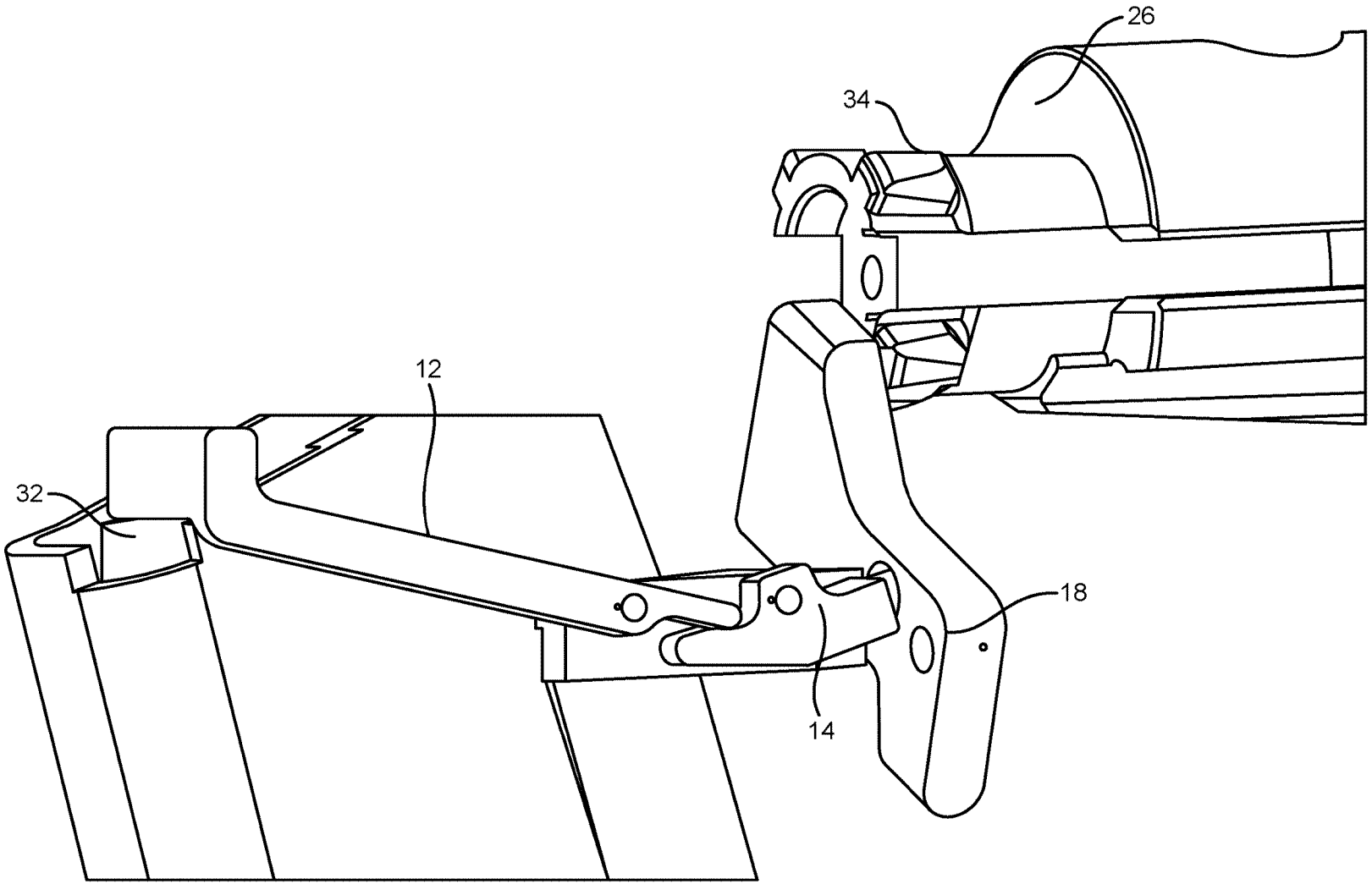
FIG. 20 is a perspective view of the LRHO apparatus of the present disclosure showing the magazine in an empty configuration.

FIG. 20 is a perspective view of the LRHO apparatus of the present disclosure showing the magazine in an empty configuration. At one end, first lever 12 is in contact with follower 32, and at its other end, makes contact with second lever 14. Second lever 14 is in contact with bolt catch 18, which is in contact with bolt 34. This keeps bolt carrier 26 held back to create an empty magazine status. LRHO apparatus 10 is preferably comprised of mechanical components without the need for springs or the like. While bolt catch 18 may, in one embodiment, use a small spring for the return position, as in standard ARs, LRHO apparatus 10 can function even if the bolt catch 18 spring was to weaken or fail, therefore adding to the reliability of the design of LRHO apparatus 10.

As seen in FIG. 20, first lever 12 has, it one end, a large surface areas that makes contact with follower 32 in the magazine. This design allows a person to use a larger variety of magazine brands or make very minor clearance cuts to follower 32 of the off-brand magazines, which would allow them to function with the LRHO apparatus 10 of this disclosure. This would allow a user, in a worst case scenario, to still make the weapon function even if a particular magazine design was not available.

Figure 21:
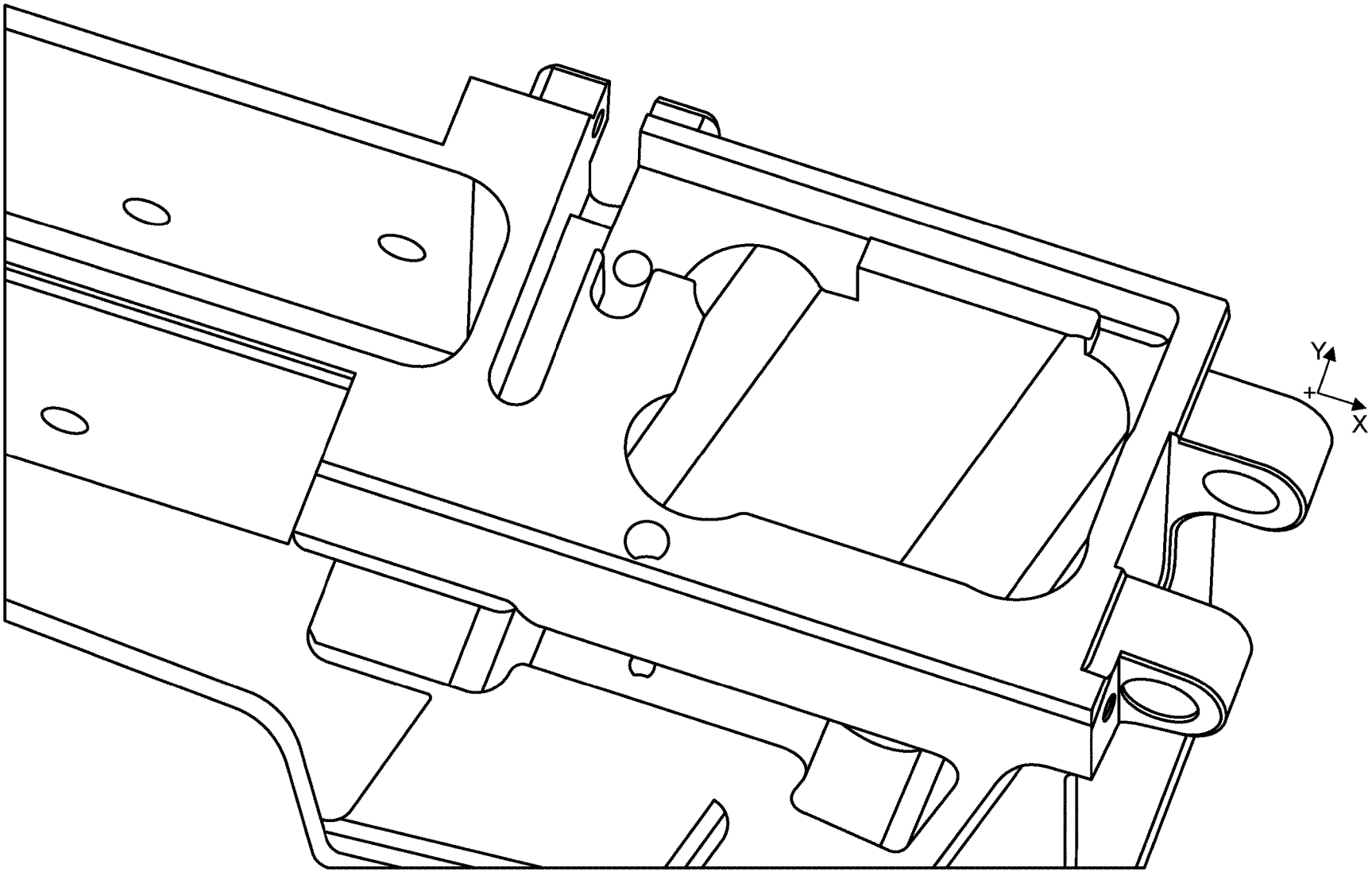
FIG. 21 is a perspective view of the LRHO apparatus of the present disclosure showing the components of the LRHO apparatus embedded in recesses.

FIG. 21 is a perspective view of the lower receiver of the LRHO apparatus 10 of the present disclosure showing the components of the LRHO apparatus 10 embedded in recesses. In this view, it can be seen that the LRHO components are embedded in various pockets and cavities that prevent any interference from a magazine being inserted into the weapon. The end result is that the LRHO components are never in jeopardy of being compromised during the changing of magazines. The design of LRHO apparatus 10 provides substantial, i.e., 95% or more, encapsulation on the inside of lower receiver 21. Slots and pockets are machined into lower receiver 21, which adds rigidity and positive location to the moving parts. By being a fully machined component design, it is not dependent on pressure-activating parts like a spring or loaded detent. The design as a whole (i.e., material, wear factors, positioning) is built to last and can easily be removed for cleaning.

Figure 22:
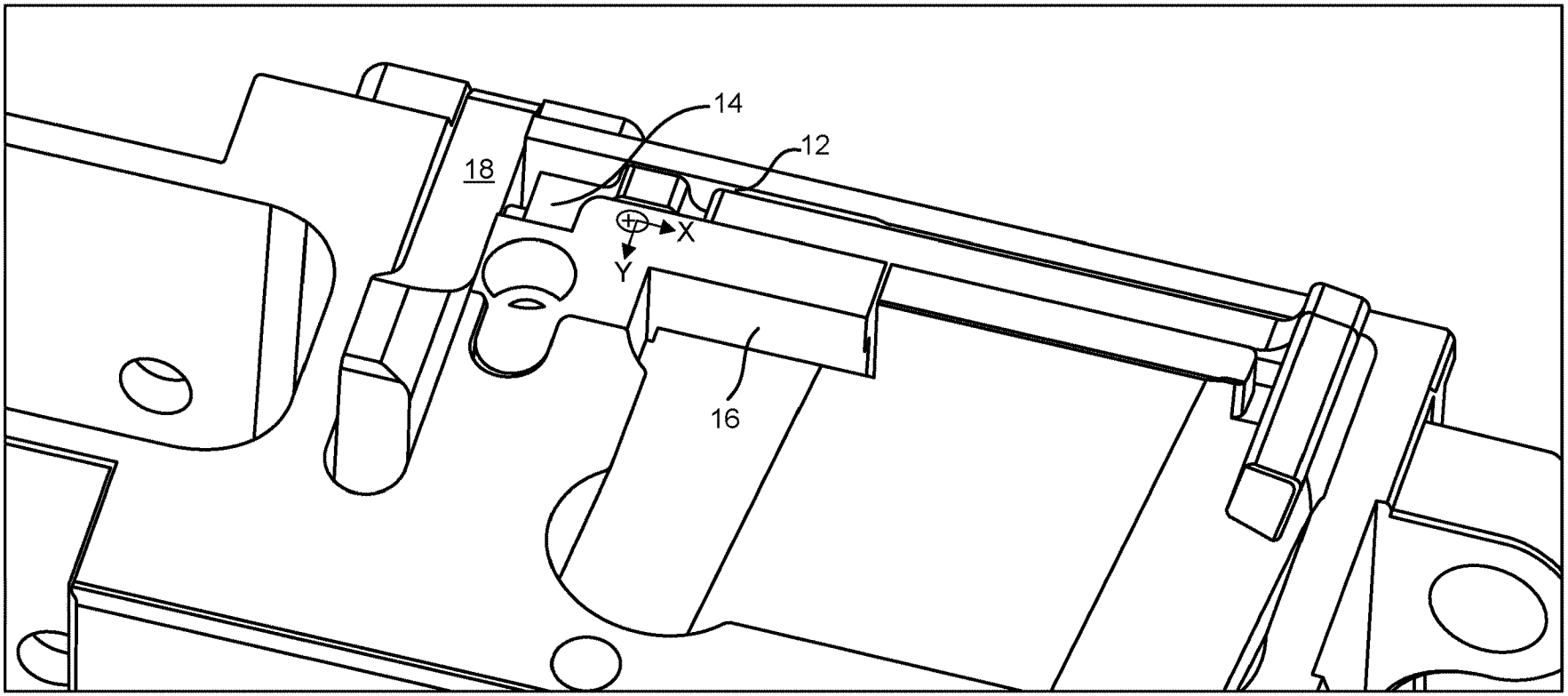
FIG. 22 is a perspective view of the LRHO apparatus of the present disclosure showing the components of the LRHO apparatus secured within the lower receiver.

FIG. 22 is a perspective view of the LRHO apparatus 10 of the present disclosure showing the components of the LRHO apparatus 19 secured within the lower receiver. As shown, all of the LRHO components are inserted into the lower receiver and bolted down and pinned through bolt catch 18 so they are locked into position.

Figure 23:
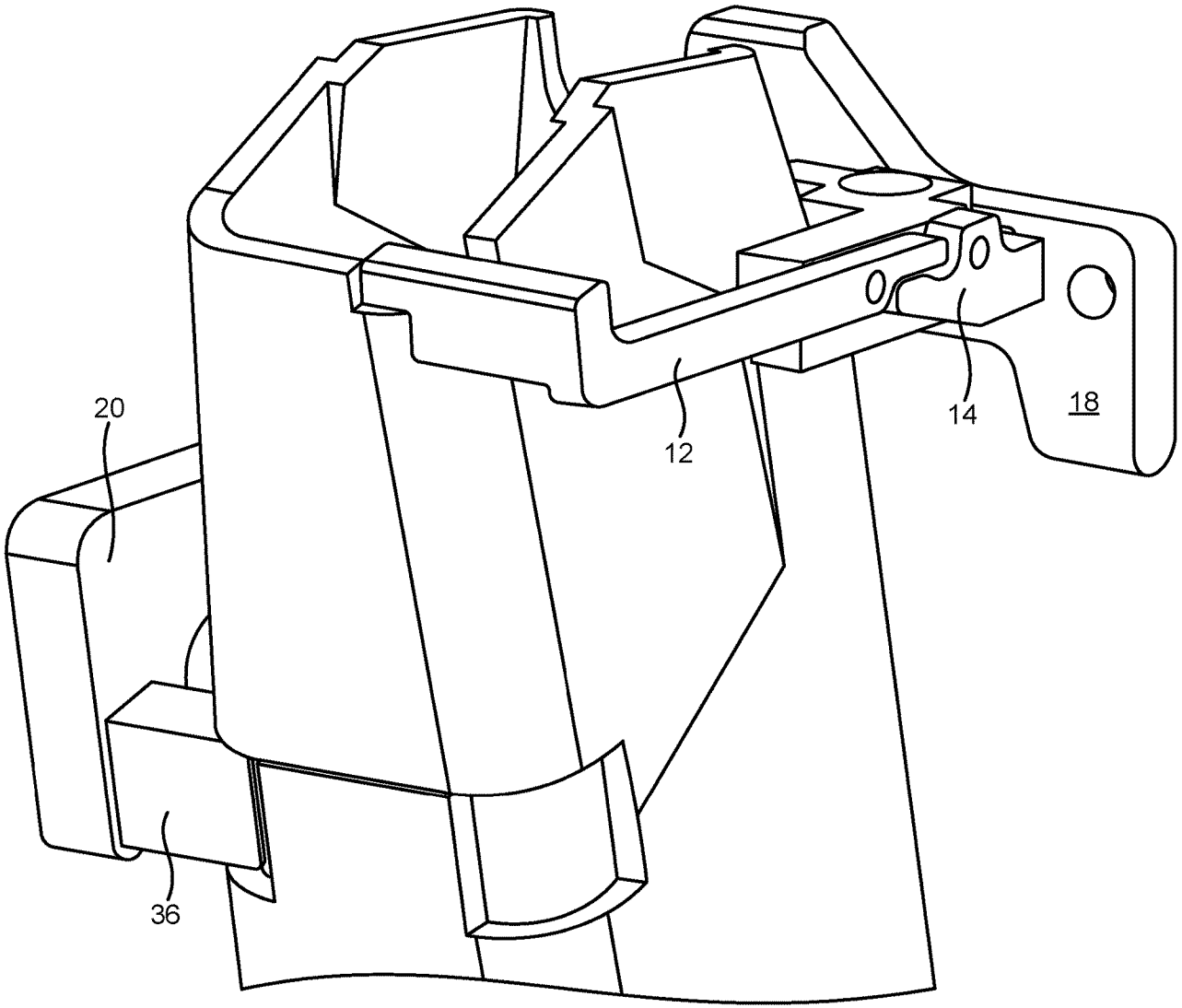
FIG. 23 is a perspective view of the LRHO apparatus of the present disclosure showing the magazine release incorporated into the lower receiver.

FIG. 23 is a perspective view of the LRHO apparatus 10 of the present disclosure showing the magazine release 20 incorporated into the lower receiver and stud 36 of magazine release 20.

Figure 24:
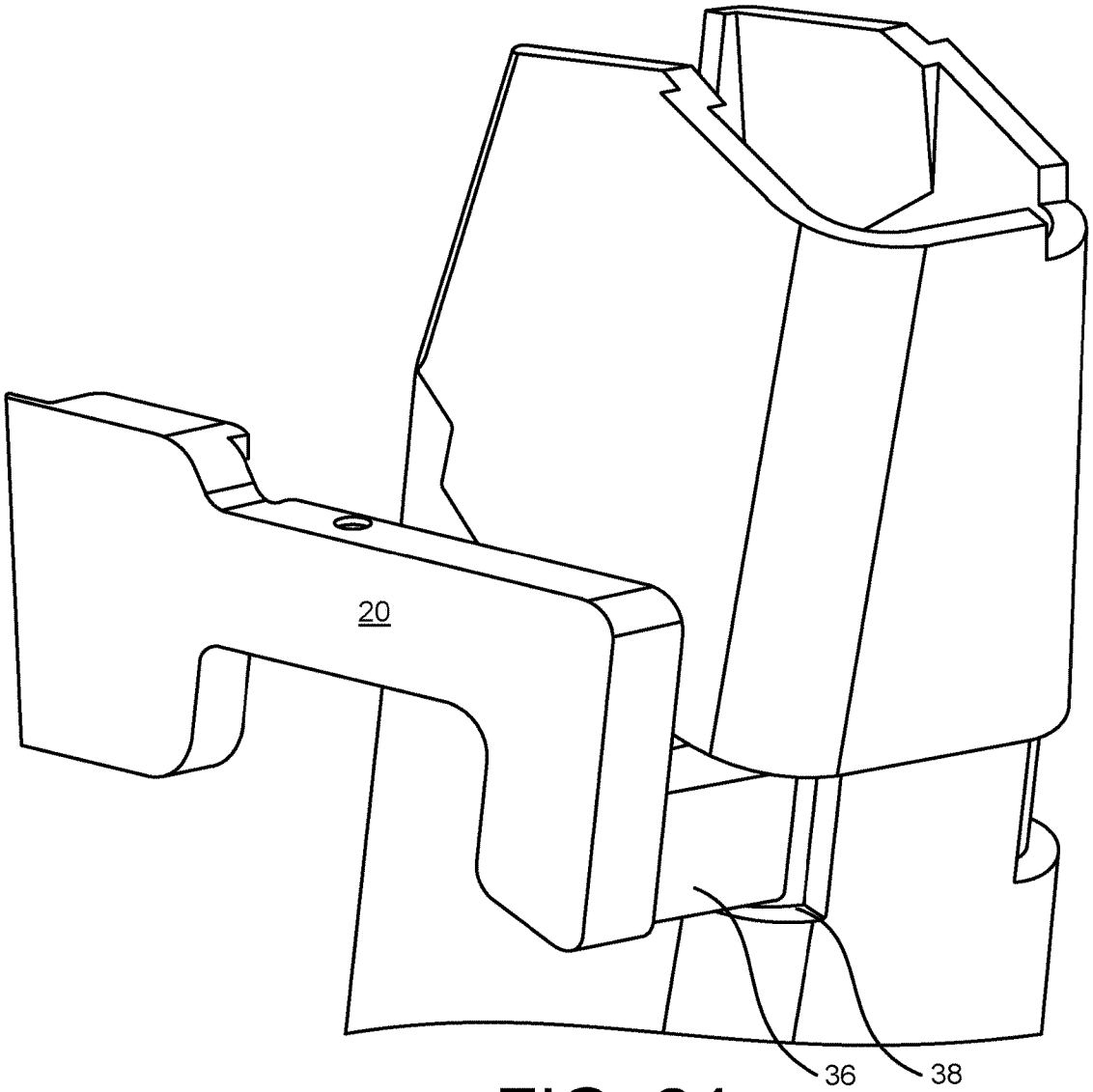
FIG. 24 is a perspective view of the LRHO apparatus of the present disclosure showing the stud of the magazine and magazine release notch preventing over travel of the magazine.

FIG. 24 is a perspective view of the LRHO apparatus 10 of the present disclosure showing the stud 36 of the magazine and the magazine release notch 38 preventing over travel of the magazine. The height and location of stud 36 is a close fit for notch 38 located in the magazine. Once stud 36 is engaged, it locks into magazine notch 38, is encapsulated by notch 38, and prevents over travel of the magazine.

Figure 25:
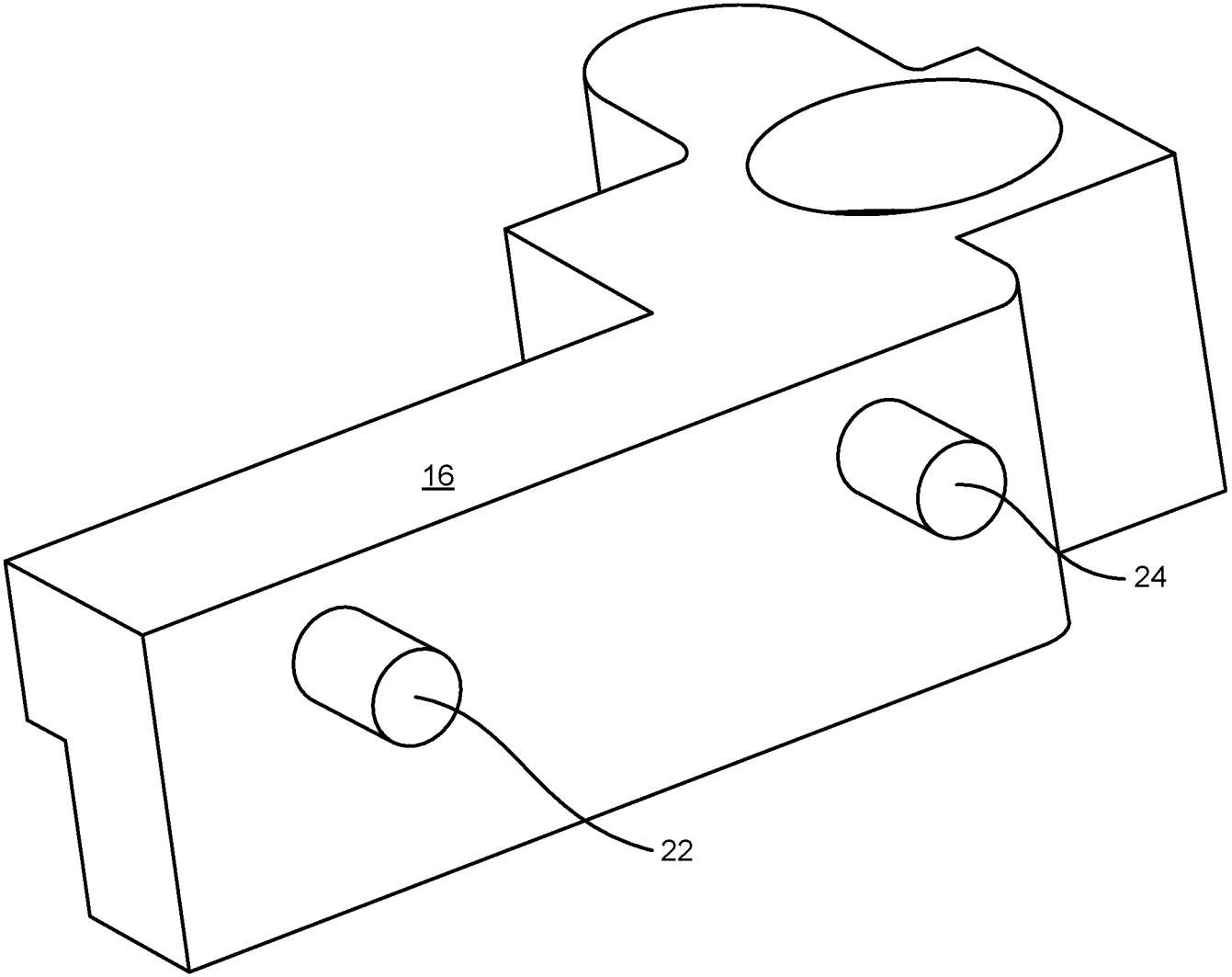
FIG. 25 is a perspective view of the LRHO apparatus of the present disclosure showing magazine stop connectors to assure alignment with first and second levers.

FIG. 25 is a perspective view of the LRHO apparatus 10 of the present disclosure showing first magazine stop connector 22 and second magazine stop connector 24 to assure alignment with first lever 12 and second lever 14, respectively. Connectors 22 and 24 are machined into magazine stop 16 to provide a precision center line for first lever 12 and second lever 14, respectively, to attach to. This assures the optimal rotating position of levers 12 and 14.

Figure 26:
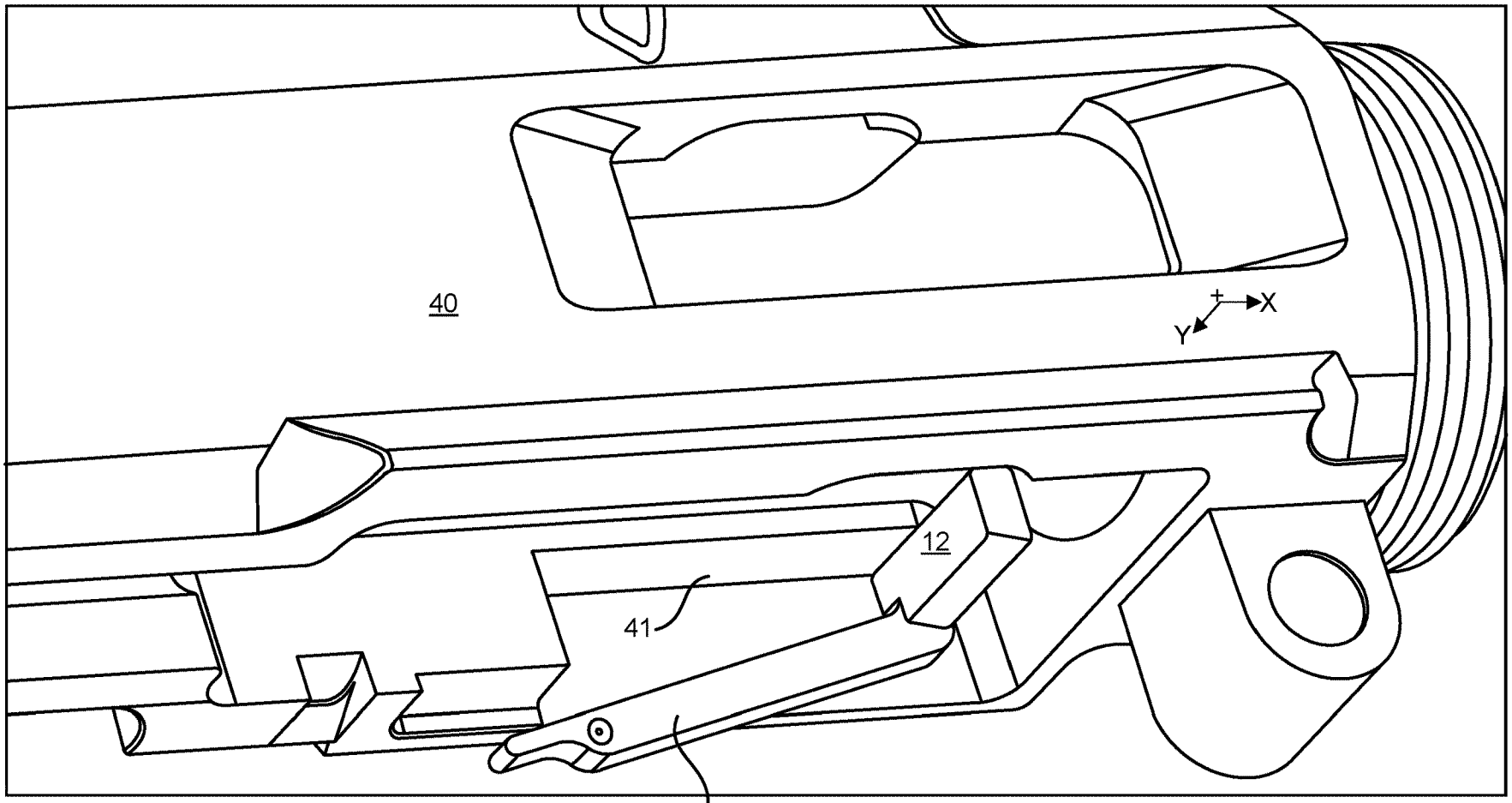
FIG. 26 is a perspective view of the LRHO apparatus of the present disclosure showing the LRHO apparatus in relation to the upper receiver.

FIG. 26 is a perspective view of the LRHO apparatus 10 of the present disclosure showing the LRHO apparatus in relation to the upper receiver 40. When first lever 12 is rotated upwards by magazine follower 32 (as shown in FIG. 20), notch 38 in upper receiver 40 prevents first lever 12 from over travel. This prevents follower 32 from trying to over travel and eliminates an over feed condition. So, when a user tries to continually make or force a sub-standard magazine into the weapon, hoping to get it to work, first lever 12 will contact the bottom of notch 38 in upper receiver 40 and stop any damage to LRHO apparatus 10.

The overall function of LRHO apparatus 10 and its components will now be described.

When the last round of a magazine is loaded into the chamber of a firearm and fired, the operator of the firearm needs to know if there is any more ammunition remaining or if the firearm has run out of ammunition. As the firearm is ejecting the last spent round, the following takes place in one simultaneous motion, in accordance with a non-limiting embodiment of the present disclosure:

1. The follower in the magazine pushes up on first lever 12.
2. First lever 12 pushes down on second lever 14.

3. Second lever 14 pushes up on bolt catch 18; a cam slot cut in bolt catch 18 causes this action to occur.
4. Bolt catch 18 is positioned in the up or open position which stops the bolt carrier 26 during its closing action.
5. This results in the firearm being in a non-functional state, alerting the operator of the firearm that they are out of ammunition and reload is required.
6. The magazine release button is activated, the empty magazine falls out and a load magazine is inserted.
7. The operator of the firearm can deactivate LRHO apparatus 10 by two methods. They can provide a small pull back motion on the charging handle. Or, they can press down on bolt catch 18 from the outside of the lower receiver. Either of these actions will deactivate LRHO apparatus 10 and load another live round into the chamber of the firearm.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the embodiments described herein are not limited to what has been particularly shown and described herein above. In addition, unless mention was made above to the contrary, it should be noted that all of the accompanying drawings are not to scale. A variety of modifications and variations are possible in light of the above teachings.

What is claimed is:

1. A last round hold open (LRHO) apparatus in a firearm, the LRHO apparatus comprising:

a first lever having a first end and a second end;

a second lever having a first end and a second end, the first end of the second lever in contact with the second end of the first lever;

a bolt catch in contact with the second end of the second lever, the bolt catch in contact with a bolt carrier; and a follower in contact with the first end of the first lever, such that when the follower pushes up on the first end of the first lever, the second end of the first lever pushes down on the first end of the second lever, and the second end of the second lever pushes up on the bolt catch, resulting in activation of the bolt catch and opening the bolt carrier to alert an operator of the firearm that the firearm is out of ammunition.

2. The LRHO apparatus of claim 1, wherein the first end of the first lever has a larger surface area than the second end of the first lever.

3. The LRHO apparatus of claim 1, wherein the bolt catch further comprises a cam slot to allow engagement between the second end of the second lever and the bolt catch.

4. The LRHO apparatus of claim 1, wherein the first lever is prevented from over travel by engaging with a notch within an upper receiver of the firearm.

5. The LRHO apparatus of claim 1, further comprising a mag stop component pivotally connected to the first lever by a first connector at a first connection point and pivotally connected to the second lever by a second connector at a second connection point, the mag stop further connected to the bolt catch.

6. The LRHO apparatus of claim 1, further comprising a magazine release situated in a lower receiver of the firearm, the magazine release extending from the first end of the first lever.

7. The LRHO apparatus of claim 6, wherein the magazine release further comprising a pivot pin, the pivot pin allowing the magazine release to be activated by pressing down on the pivot pin.

8. The LRHO apparatus of claim 6, wherein the magazine release further comprises a precision cut locator boss such that when a locator notch in a magazine engages the boss, over travel of the magazine is prevented.

* * * * *